US007124979B2

(12) United States Patent
Pasquale

(10) Patent No.: US 7,124,979 B2
(45) Date of Patent: Oct. 24, 2006

(54) WINDER WITH CONSTANT PACKING ROLL

(75) Inventor: Robert A. Pasquale, Hawthorne, NJ (US)

(73) Assignee: New Era Converting Machinery, Inc., Patterson, NJ (US)

( * ) Notice: Subject to any disclaimer, the term of this patent is extended or adjusted under 35 U.S.C. 154(b) by 165 days.

(21) Appl. No.: 10/734,087

(22) Filed: Dec. 10, 2003

(65) Prior Publication Data

US 2005/0127231 A1 Jun. 16, 2005

(51) Int. Cl.
*B65H 19/22* (2006.01)

(52) U.S. Cl. ..... 242/533.4; 242/533.5; 242/533.6; 242/559.2

(58) Field of Classification Search ..... 242/533.6, 242/533.4, 533.5, 474.5, 559.2
See application file for complete search history.

(56) References Cited

U.S. PATENT DOCUMENTS 3,478,975 A * 11/1969 Penrod ..... 242/532
4,422,586 A 12/1983 Tetro
4,431,140 A 2/1984 Tetro
4,529,141 A * 7/1985 McClenathan ..... 242/527.1
4,971,263 A * 11/1990 Belongia et al. ..... 242/533.4
4,993,652 A 2/1991 Moeller
5,909,856 A * 6/1999 Myer et al. ..... 242/530

* cited by examiner

*Primary Examiner*—Kathy Matecki
*Assistant Examiner*—Sang Kim
(74) *Attorney, Agent, or Firm*—Darby & Darby

(57) ABSTRACT

According to one exemplary embodiment, a turret-type winder is provided and includes a rotatable turret assembly having a first core and a second core supported thereby. The turret is rotatable so that the first core can be positioned at a first location while the second core is positioned at a different second location, and the web material can be wound onto either of the first and second core at either of the first and second locations. The winder includes a pack roll assembly associated with each of the first and second cores, with the pack roll assembly including one pack roll that is pivotably movable into contact with a winding roll. The present winder is configured such that each of the first and second cores is unloaded at the first location after the winding is completed thereon and a new core is loaded at the same first location, while the other of the first and second cores is continuously winding at the second location.

29 Claims, 18 Drawing Sheets

WINDER WITH CONSTANT PACKING ROLL

TECHNICAL FIELD

The present invention relates to continuous winding of web materials and more particularly, to a device that is configured so that either pressure is applied to a winding roll at a point of entry of the web throughout the entire winding cycle or a minimum gap between the last roll and the winding roll about the point of entry of the web is maintained throughout the entire winding cycle.

BACKGROUND

There are a number of different types of machinery that generally act to continuously wind a web material, such as thin plastic films (e.g., thin polypropylene films) as well as paper, paperboard and other type of web materials, after the web material has been processed in a predetermined manner. This type of machinery is available for use in an automated line environment where it is desired to continuously wind the web material.

Most often, the winder is one of the last pieces of equipment in the line where the resulting product is wound around a core or the like for storage, transportation, etc., and therefore, the winder typically follows an oven or the like where the web material, including any coatings thereof, and any other layers are processed to form the resulting product. Because the web material is advanced from one station to the next station, it is important that there are no delays or disruptions in the entire process. For example, if the winder machine has to be taken off line, the upstream web material may be kept in the oven too long and this can lead to direct damage of the web material and even destruction of the web material so that it has to be entirely discarded. Thus, it is desirable that the winder machine have the capability to operate continuously and as individual rolls are formed, there is as near seamless of a transition from a completed roll to an empty core which receives a leading edge of the web material.

In the continuous winding of these web materials, it is very important to maintain control over the tension in the web material throughout as much as possible of the winding process, and particularly, during the change of a full roll to a new core that receives the web material. One of the disadvantages of this type of process and the winding device is that the tension that is applied to the outer wraps of the roll is insufficient to exclude air from being drawn in between the outer wraps, especially during the roll changing motion, air is drawn into the space between the outer wraps and becomes entrapped between the wraps. This air entrapment between the outer web wraps produces wrinkles, bunching, telescoping or skewing in the outermost portion of the roll. As the winding roll is driven to wrap the web material, air is drawn around the rotating winding roll and at the point where the web material contacts the outermost wrap and itself becomes the next outermost wrap, a pressure condition exists and results in air being drawn into this space between the web material and the outermost wrap.

One type of web winder apparatus is a continuous turret-type winder. Turret-type winders have commonly been used with roll changers or accumulators by which each of a pair of core-supporting spindles, which are disposed at ends of the turret arms, are sequentially loaded with a core. A freshly cut leading edge of the web material is attached to the core by any number of suitable devices, such as a roller device. At a particular point in the winding action, the winding roll is indexed about 180 degrees to deliver a fresh core on the recently unloaded spindle of the turret arms to the web transfer station and to deliver the winding roll to an unloading station while the winding continues.

In a continuous winding operation, especially on turret-type winders and particularly for certain kinds of web materials, there are a number of considerations that need to be taken into account in order to produce a uniformly wound roll that is free of defects. One of the foremost considerations to take into account on a turret-type winder is the above-mentioned problem of air entrapment. In order to combat this from happening, it has become relatively common place to provide a pressure roll positioned against the winding roll to control the winding process and eliminate or substantially eliminate the aforementioned problem. More specifically, the pressure roll acts to expel the air layer at the incoming web and prevent this air from being trapped between successive layers. However, the operation of such a roll is complicated in a turret winder as a result of the normal action of the device during and following indexing of the winding roll since during this action, the winding roll moves away from the pressure roll. As a result, air is permitted to enter between the web material layers and this results in the aforementioned problem of slippage between the layers.

Several solutions of this problem have been proposed including the continuous pressure roll winder disclosed in U.S. Pat. No. 4,431,140. This device includes pivotally mounted pressure rolls which contact the cores and the winding roll throughout the entire winding process and throughout the indexing of the turret arms from a core loading station to a roll unloading station while maintaining the relative geometry of contact such that the web contacts the pressure roll at or before contacting the winding roll.

While the device disclosed in the '140 patent solves some problems associated with previous winding devices, the '140 device still suffers from disadvantages. More specifically, the '140 device is constructed such that the turret arm are rotated to a first position to permit a full roll to be removed from the device, at generally the nine o'clock position, while the new core winds at a three o'clock position as shown in the Figures of the '140 patent. The three o'clock position is also the position where the cutting mechanism along with other complex mechanisms are located and therefore, the three o'clock position is fairly crowded. In the '140 device, after the finished roll is removed, a new core is not inserted at the nine o'clock position since if a new core was inserted here, the rotation of the turret arm in the clockwise direction to place the current winding roll in the nine o'clock unloading direction would result in interference between the new core and the web material as it is fed along rollers and the like to the pack roll assembly, etc. and then onto the winding roll. As will be appreciated by viewing the figures of the '140 patent, the clockwise rotation of the turret arm would cause a new core inserted at the nine o'clock position to fold over onto the web as it is being fed to the pack assembly. In other words, the location and action of the web material prevents the rotation of the winding roll to the unloading location since the new core can not pass through the web material that is trained across rollers and the like.

Instead, the '140 device has to be operated such that the full completed core is removed from the nine o'clock position as the new core winds in the three o'clock position; however, a new core can not be inserted at the unloading location (nine o'clock position) for the reasons stated above. The new core has to be inserted at the three o'clock position after the turret arm is rotated so that the winding roll moves from the three o'clock position to the nine o'clock position. In other words, the new core can not be loaded at the same location where the old finished core is unloaded. One of the disadvantages of this type of scheme is that the three o'clock position in the '140 device is not that accessible due to the presence of other equipment, such as the cutting devices, and therefore it is not easy for a core loader to be disposed at this location. Furthermore, this type of arrangement where the finished core is unloaded at one location and a new core is inserted at another location requires multiple pieces of equipment at two locations to complete these tasks. In other words, unloading equipment is located near the unloading location and loading equipment is located near the loading location. Accordingly, the same equipment can not be used to perform both the unloading and loading operations and this greatly increases the complexity of the design and increases crowding of the various components and reduces accessibility at different locations.

What has heretofore not been available is a continuous winder that permits pressure to be applied to a winding roll at a point of entry of the web throughout the entire winding cycle and also permits a new core to be immediately inserted at the same location where a finished roll was just removed while the winding of a new roll continues at another location. In addition, it is desirable for this same device to allow for the pack rolls to be run in a gap position with a minimal distance being maintained between the roll and the building winding roll.

SUMMARY

According to one exemplary embodiment, a turret-type winder is provided and includes a rotatable turret assembly having a first core and a second core supported thereby as by a pair of mandrels. The turret is rotatable so that the first core can be positioned at a first location while the second core is positioned at a different second location, and the web material can be wound onto either of the first and second core at either of the first and second locations. The winder includes a pack roll assembly associated with each of the first and second cores, with the pack roll assembly including one pack roll that is movable, either in a pivot or other method, into contact with one core with a winding roll thereon so that a web leading onto the one core from a web source contacts the associated pack roll at or prior to winding thereof on the winding roll for effectively excluding entrapped air prior to forming of convolutions on the roll in a winding position at either of the first and second locations and locations therebetween. This system can also be used with the pack roll gapped leaving a minimum distance from the roll to the building web roll.

The present winder is configured such that each of the first and second cores is unloaded at the first location after the winding is completed thereon and a new core is loaded at the same first location, while the other of the first and second cores is continuously winding at the second location. The turret and pack roll assemblies are configured to permit the new core to be rotated to the second location, while the core with the winding roll thereon is rotated to perform unloading at the first location without any interruption of winding thereon. As previously mentioned, the traditional winders do not permit continuous winding with a pack roll while also permitting unloading of a completed winding roll and loading of a new core at the same location as is advantageously permitted in the present design.

In one embodiment, the winder includes first and second rotatable end support members and two pairs of first and second spindle support assemblies that can be movable along respective guide tracks that are disposed outside of the first and second rotatable end support members. Each spindle support assembly has a spindle bearing housing that extends through an opening formed in one of the first and second end support members, with each of the spindle bearing housings having a drive feature disposed therein for coupling with and for driving a spindle that supports one core for winding rolls thereon.

The winder also includes two pairs of pack roll support assemblies that are disposed concentric with and rotatable about the spindle bearing housings, one for each spindle end, with each of the pack roll support assemblies having a carriage that controllably travels along a length thereof. The carriage rotatably carries one pack roll that is movable, either by pivot or other method, into contact with one core with a winding roll thereon so that a web leading onto the core from a roll changer contacts the associated pack roll at or prior to winding thereof on the winding roll for effectively excluding entrapped air prior to forming of convolutions on the roll in a winding position. This system also allows the pack roll to be used in a gap mode with the roll maintain a minimum gap to the winding roll throughout buildup.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which.

Figure 6:
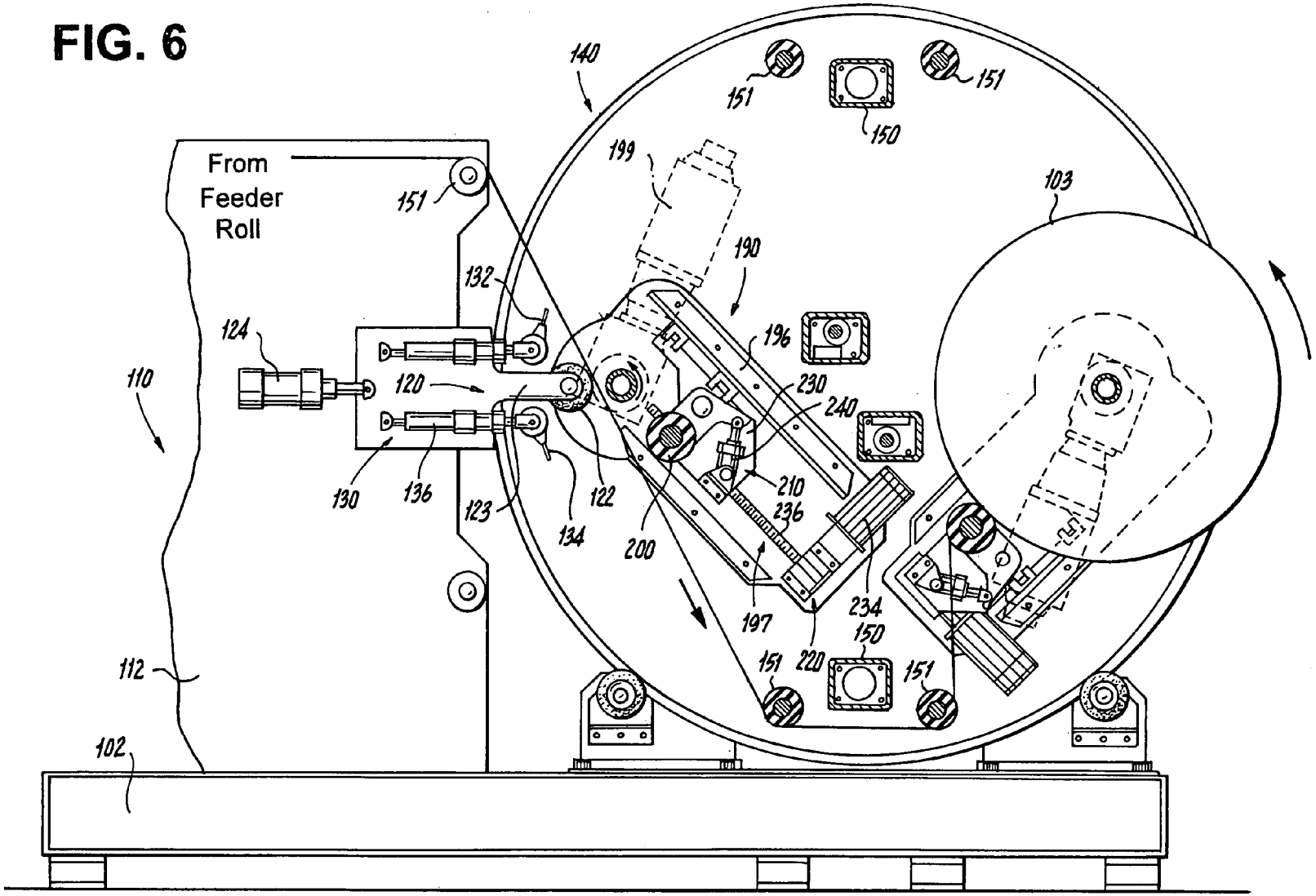
FIG. 6 is a side elevation view of the continuous turret-type winder of FIG. 1 showing the winder in a first position and winding of a web material on a first winder roll.
Figure 16:
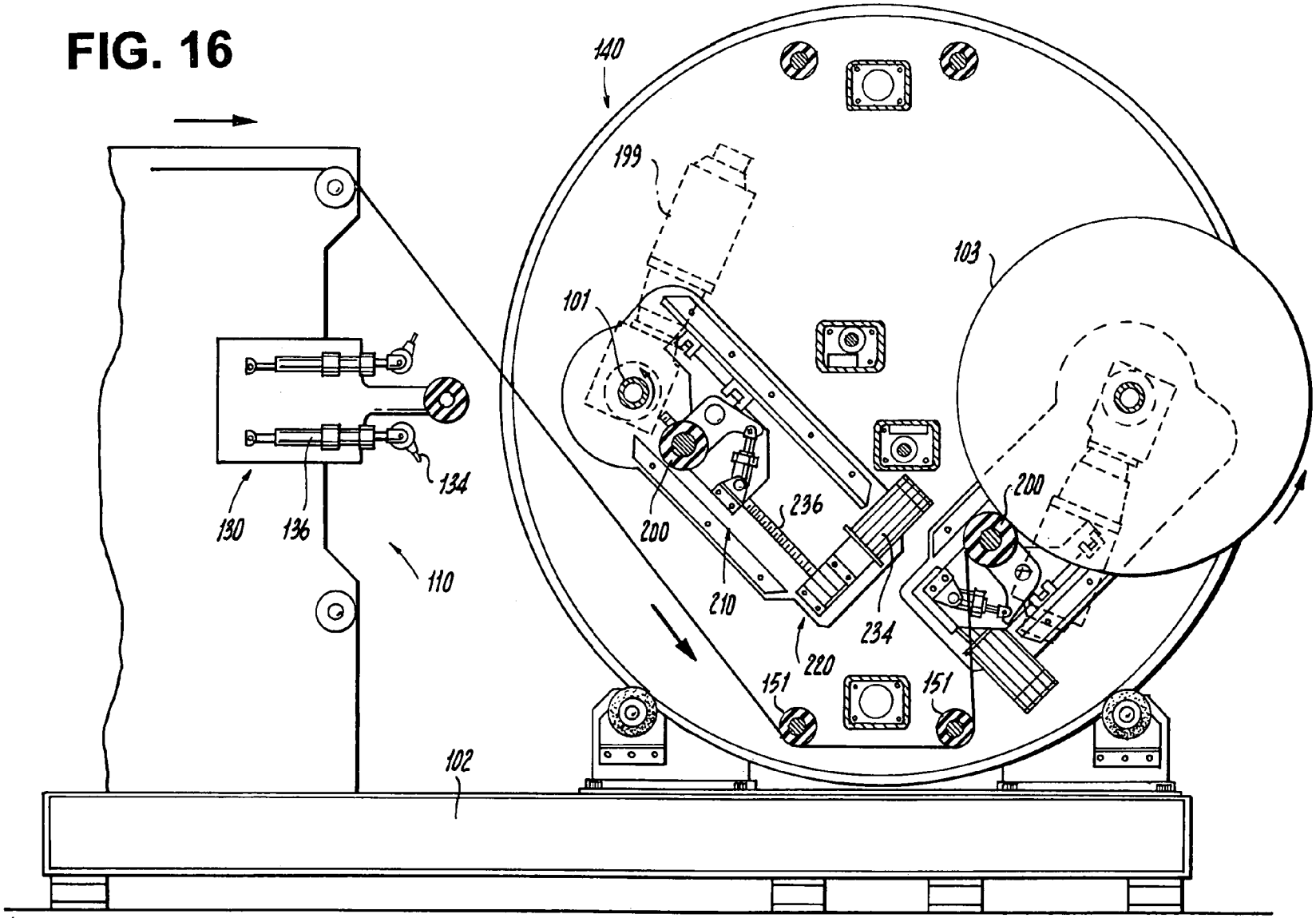
Figure 17:
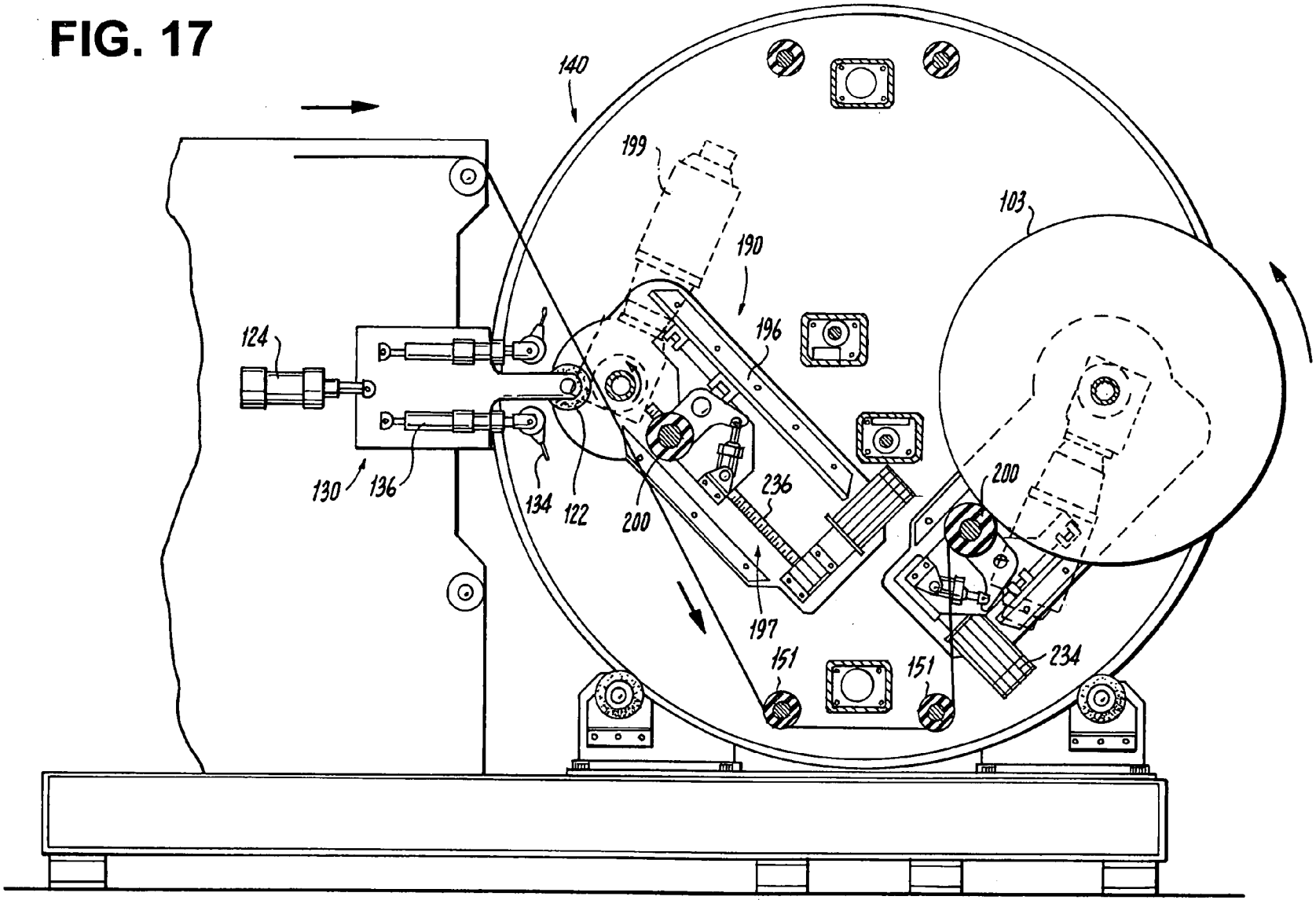

FIG. 16 is a side elevation view of the winder of FIG. 6 in an eleventh position illustrating rotation of the second winder roll 180 degrees so that is assumes the previous position of the first winder roll; and FIG. 17 is a side elevation view of the winder of FIG. 6 with the bumper roll and cutter being moves toward the empty first winder roll as the winding of the second winder roll nears completion.

DETAILED DESCRIPTION OF PREFERRED EMBODIMENTS

Referring first to FIGS. 1–5, a turret-type winder according to one exemplary embodiment is generally illustrated at 100. The winder 100 is mounted on a base 102 that is fastened to the floor or the like. The base 102 also supports a roll changer 110 which is formed of a frame 112 that supports a bumper roll (transfer roll) assembly 120 and a cutting device 130. The roll changer 110 is movable along guide tracks formed in the base 102 to permit the roll changer 110 to be extended to and retracted from the main winding components of the winder 100. The bumper roll assembly 120 includes a bumper or transfer roll 122 and an actuator 124 for causing the rapid movement of the bumper roll 122 in a predetermined direction. The function of a transfer roll 122 is known in the art and will be described in greater detail hereinafter when the transfer of a web material from one winding roll to another is described.

The illustrated transfer roll 122 is coupled to a frame 123 such that it extends outwardly therefrom at one end thereof. The actuator 124 can take any number of different forms so long as it is constructed to cause the rapid movement of the bumper roll 122 when the actuator 124 is activated. For example, the actuator 124 can be in the form of a bumper roll 122 firing cylinder (pneumatic) that is operatively connected to the frame 123 so as to cause the rapid advancement of the bumper roll 122 when the actuator 124 is activated. In the illustrated arrangement, the bumper roll 122 is fired in a lateral direction in that the activation of the actuator 124 causes the bumper roll 122 to be driven sideways.

The cutting device 130 is also formed of a number of operative parts that are actuatable to cause the controlled advancement of the cutting device 130. The cutting device 130 includes a first knife 132 and a second knife 134 that are mounted to the frame 112. Each of the first and second knives 132, 134 is operatively connected to an actuator 136 that is constructed to rapidly advance the respective knife 132, 134 in a controlled manner. One exemplary actuator 136 is a firing cylinder (similar to the cylinder 124) that is typically pneumatic in nature and is operatively connected to one respective knife 132, 134 so as to cause the linear advancement of the knife. For example, the firing of the cylinder 136 typically causes the knife 132, 134 to advance in a lateral direction (sideways) toward the web material that is being advanced.

The actual blade of the respective knife 132, 134 can be set in a desired position so that it contacts the web material at a desired angle when it is fired and rotated by the actuator 136. The cylinders 136, along with the cylinder 124, are in communication with a controller (not shown) which permits the firing of one or more of the cylinders at select times. For example, the cylinders 136 are operable so that only one can be fired at a given time depending upon the application, e.g., winding direction, etc. The controller is also designed so that staged firings can occur between the cylinders 136, 124. In other words, it is common practice for the bumper roll 122 to be fired into contact with the web material prior to a cutting action being executed and therefore, the cylinder 124 is first activated before activation of one of the cylinders 136.

The turret winder 100 includes a pair of end support members 140 that are designed to support two spindle positions and can take any number of different forms. For example, they can be in the form of a pair of ring gears that have an annular shape. The ring gears 140 are spaced apart from one another a predetermined distance to accommodate a number of the movable winder components to be disposed therebetween. A plurality of cross support members 150 (e.g., rectangular tubing cross shafts) extend between the end support members 140 and are connected at their ends to the ring gears 140 to provide support for the end support members 140 and cause the ring gears 140 to remain in a position where they are parallel to one another and vertically orientated. The end support members 140 are supported in a rotatable manner in that they and all components mounted thereto can be rotated 360 degrees. For example, the end support members 140 can be supported by a plurality of rollers (roller supports) 142.

The rotation of the winder 100 is driven through the rotation of the end support members 140 by action of a motor 103. The motor 103 is of the type that can be driven in two directions and is coupled to the winder 100 in a number of different forms. For example, the motor 103 can be coupled to a first drive gear 105 that is disposed external to the end support members 140. Since the motor 103 is bidirectional, the drive gear 105 can be driven in two directions also. The first drive gear 105 is operatively coupled to an idler gear 107 which in turn is operatively coupled to a second drive gear 108 that is much larger in size than the drive gear 105. Therefore, rotation of the first drive gear 105 is directly translated to rotation of the second drive gear 108 in the same direction. The second drive gear 108 includes an inner face 109 that faces one of the end support members 140 (ring gear).

A pair of cross support members 111 that can house a drive mechanism extend between and are securely coupled to the second drive gear 108 at its inner face 109 thereof and an outer face of the end support member 140. The illustrated cross support members 111 can be hollow tube-like members that have a rectangular cross sectional shape. Since the ends of the cross support members 111 are securely fastened to the second drive gear 108 and the end support member 140, rotation of the second drive gear 108 is directly translated into rotation of the end support member 140 and since the end support members 140 are securely connected to one another by means of the cross support members 150, the rotation of one end support member 140 is directly translated into rotation of the other end support member 140 such that the entire construction rotates in unison.

The end support member 140 can include several openings 113 that are aligned with the inside of the cross support members 111 to permit a component to pass from the cross support member 111 through the opening 113 to a location between the end support members 140. The cross support members 111 actually continue between the two end support members 140 in that there are two sections of the cross support members 111 that extend between and are securely connected to the inner faces of the end support members 140. These sections 111 are preferably identical to the other cross support member sections 111 so that hardware, such as the drive mechanism can be housed therein and can continue therein uninterrupted from a location external to the end support members 140 to a location internal.

There are cross support members 111 securely connected to an outer face of the other end support member 140. These cross support members 111 are similar to the cross support members 111 that extend between and are connected to the second drive gear 108 and the other end support member 140 with the exception that one end of these cross support members 111 are connected to a rotatable support member 115 (as opposed to the second drive gear 108). In the illustrated embodiment, the support member 115 is in the form of a disk shaped member that is rotatably supported and rotates in unison with the other support components.

The winder 100 includes two spindle support assemblies 170. These are designed to support the winding rolls in one of several different methods. Illustrated here is one of several methods to allow for holding the winding roll. In this case one exemplary drive mechanism 117 that is received within the inside of the various cross support members 111 is preferably of a drive screw (drive spindle) or the like. More specifically, there are two pairs of cross support members 111 that each forms a protected passageway for the drive screw 117. One drive screw 117 is associated with one winding mandrel, while the other drive screw 117 is associated with the other winding mandrel. The drive screw 117 has two ends 119, 121 and is arranged such that the first end 119 is coupled to a drive motor 123 that is disposed proximate the support member 115 (i.e., between the support member 115 and one end support member 140). The other end 121 extends through the cross support member 111 that is attached between the second drive gear 108 and one end support member 140. This end 121 can terminate in a bearing or the like that permits the drive screw 117 to be freely rotatable under the action of the drive motor 123. The drive motor 123 is of the type that can rotate in both directions and therefore, the drive screw 117 can be driven in two directions as well. As will be described in greater detail hereinafter, rotation of the drive screw 117 is translated into axial movement of a member along the length of the drive screw 117 by means of an interface plate 125 or the like. For example, each drive screw 117 is operatively coupled to two interface plates 125 with one plate 125 being disposed between the second drive gear 108 and one end support member 140 and the other plate 125 is disposed between the support member 115 and the other end support member 140. The drive screw 117 is configured so that rotation thereof in one direction causes the interface plates 125 to move towards one another, while rotation of the drive screw 117 in the other direction causes the interface plates 125 to move away from one another.

The winder 100 can be designed to include components that permit winding mandrels 101 of different lengths to be used in the winder 100. This permits web materials of different dimensions, e.g., widths, to be used and accordingly, resultant wound web products of different widths can be formed. More specifically, the winder 100 has two winding mandrels 101 that are received between the end support members 140. It will be appreciated that the winder 100 is of the type that supports two mandrels 101 with one mandrel being actively wound and the other mandrel either being in an unloading position to unload a completed wound roll or in a transfer position where the mandrel supports a core that is about to be moved into position to receive the web material. The adjustability of the spindle support mechanisms permits different sized mandrels (cores) to be used (e.g., 60 inch or 36 inch). It will be appreciated that the terms "mandrel" and "core" can be used interchangeably and refer to a member that supports and receives the web.

In order to accomplish this and permit such action, a spindle support assembly 170 is provided and is outboard in nature in that it is disposed external to one of the end support members 140. In other words, it is not between the end support members 140 but rather is external thereto and is operatively coupled to one end of each of the winding mandrels 101 which each carries and supports a core that receives the web material. Each winding mandrel 101 has an associated spindle support assembly 170 and each drive screw 117 is associated with one spindle support assembly 170.

Each spindle support assembly 170 includes a pair of dual cross struts 172 that serve as guide tracks for outboard spindle supports 174 such that the spindle support members 174 can either be driven "in" toward the end support members 140 or they can be driven in the opposite "out" direction away from the end support members 140. Each spindle support 174 generally resembles a triangular shaped support member with the base of the triangle being the section that engages and travels along a length of a pair of cross struts 172. For example, the cross struts 172 can include a pair of ball bushing slides that are slidably engaged therewith so as to permit movement of the spindle support 174 along the cross struts 172. The spindle supports 174 can be thought of as turret arms similar to those found in the prior art references.

Preferably, the spindle support 174 is operatively coupled to one interface plate 125 such that movement thereof results from the plate 125 being driven by rotation of the drive screw 117. There are two pairs of cross struts 172 with one pair being disposed between and securely attached to the support member 115 and one end support member 140, while the other pair of cross struts 172 is disposed between and securely attached to the second drive gear 108 and the other end support member 140.

Opposite to where the spindle support 174 engages the cross struts 172, the spindle support 174 includes a winding spindle bearing housing 175 that is securely mounted to the spindle support 174. More specifically, the spindle bearing housing 175 is in the form of an elongated hollow tube-like member that is securely attached (e.g., bolted) at one end to the spindle support 174 and passes through one of the end support members 140. The function and position of the opposite distal end of the elongated housing 175 will be described hereinafter.

The spindle supports 174 are driven by a motor or the like 123 that is operatively connected thereto via the drive screw 117 to permit the spindle supports 174 to be moved "in" and "out". It will be appreciated that since the spindle bearing housing 175 (including the elongated member thereof) is coupled to the spindle supports 174, the driving action of the spindle supports 174 is translated into movement of the spindle bearing housings 175. As described below, the spindle support assembly 170 serves as the means for supporting the mandrel 101 that carries the web core and therefore, the adjustability of the spindle supports 174 permits different length mandrels 101 to be used and this directly translates into the ability to wind different sized web materials, e.g., web materials of different widths.

The spindle bearing housings 175 pass through openings 177 formed through the end support members 140 so as to permit the distance between the spindle bearing housing 175 to either be increased or decreased, thereby permitting insertion of the mandrel 101 between the spindle bearing housings 175 so that it can be securely attached thereto, as well as be removed therefrom when the housings 175 are driven in the opposite direction.

As illustrated, the spindle bearing housing 175 includes a spindle drive shaft 187 that extends within the spindle bearing housing 175 along a length thereof and includes a first end and a second end. The first end is operatively coupled to a drive motor 193 that serves to rotate the spindle drive shaft 187. Preferably, the drive motor 193 is of the type that can be driven in two directions, thereby permitting the spindle drive shaft 187 to be rotated in two directions. The spindle drive shaft 187 passes through a first bearing disposed within the spindle bearing housing 175 near the motor 193 and it passes through a second bearing disposed within the spindle bearing housing 175 at the opposite end thereof. It will be appreciated that the first and second bearings support the drive shaft 187 in a manner that permits rotation thereof. An input port 161 can be formed near the motor 193 and is in communication with an inside of the drive shaft 187 so as to permit air to be pumped through the drive shaft 187 to its second end for reasons discussed hereinafter.

Figure 1:
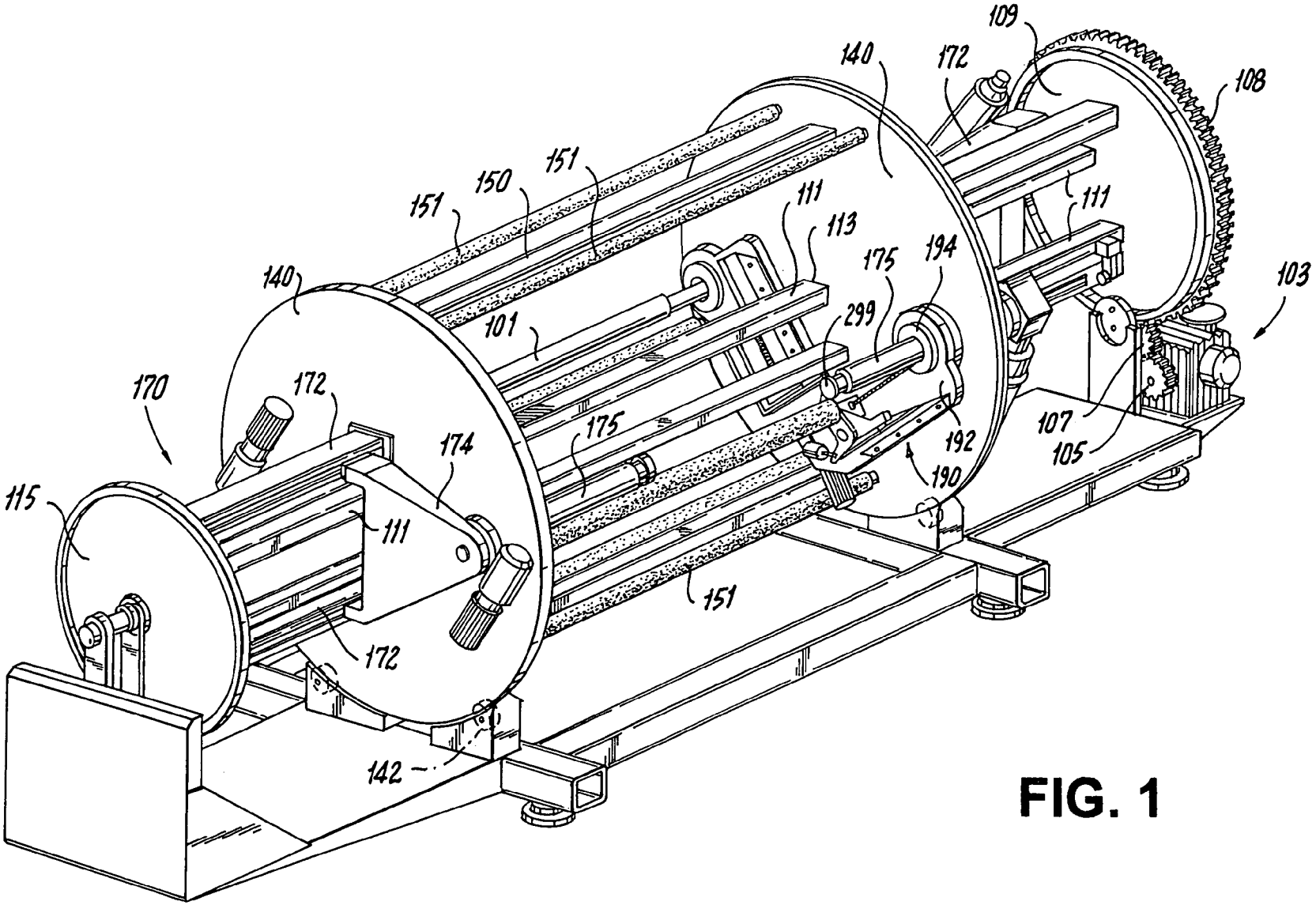
FIG. 1 is a perspective view of a continuous turret-type winder according to one exemplary embodiment.
Figure 2:
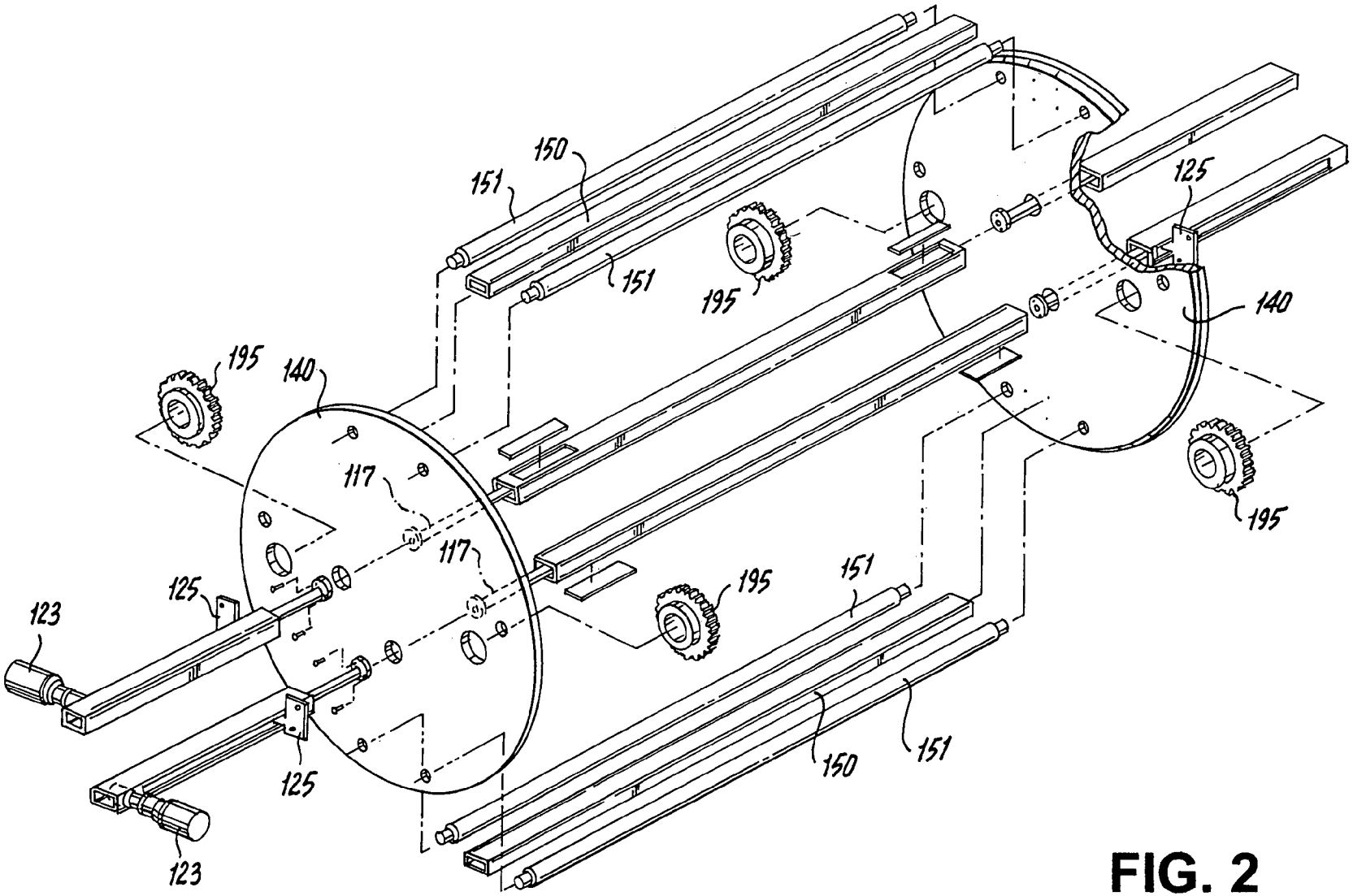
FIG. 2 is an exploded perspective view of several frame components of the winder of FIG. 1.
Figure 3:
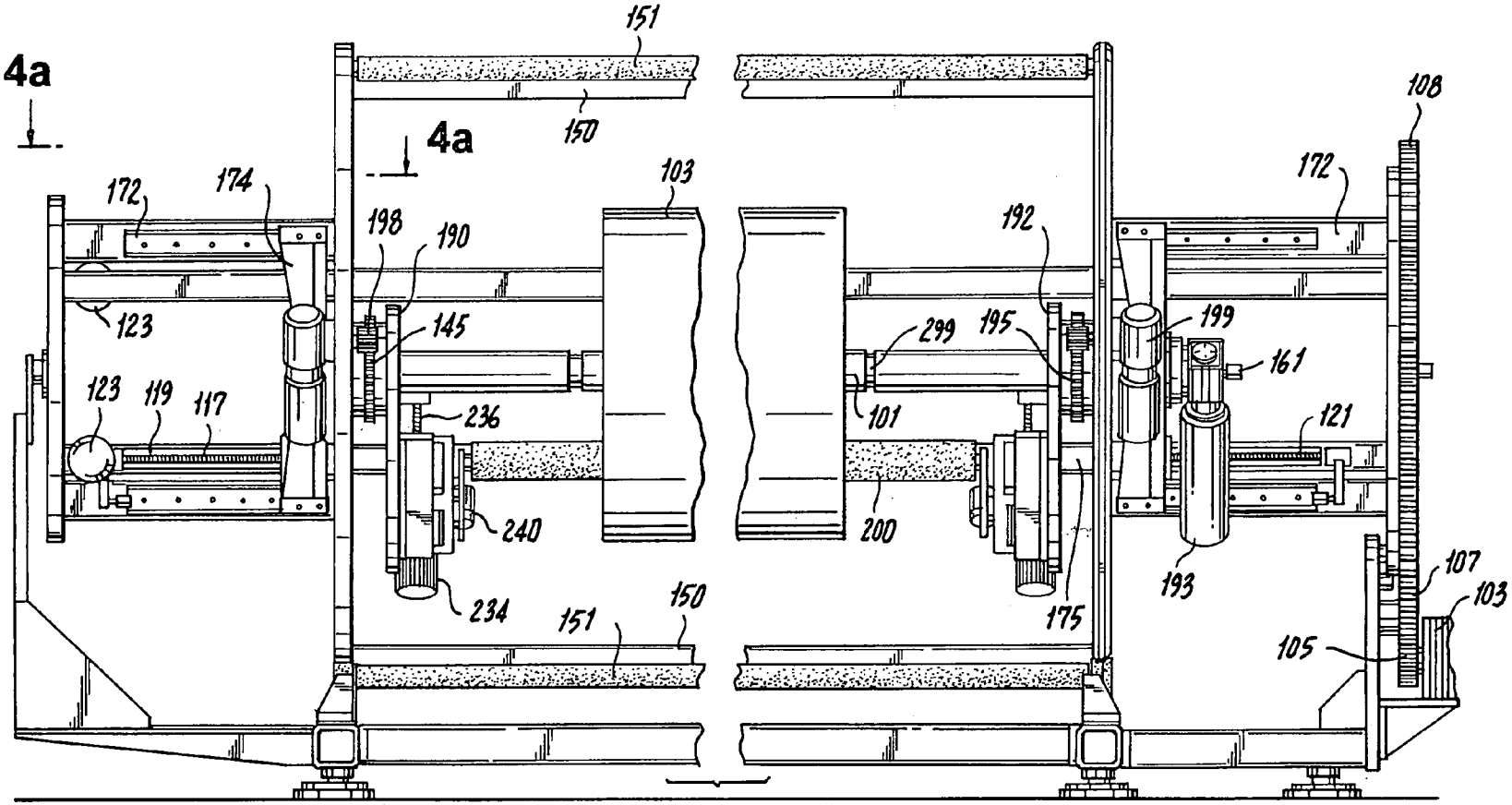
FIG. 3 is a side elevation view of the winder of FIG. 1.
Figure 4A:
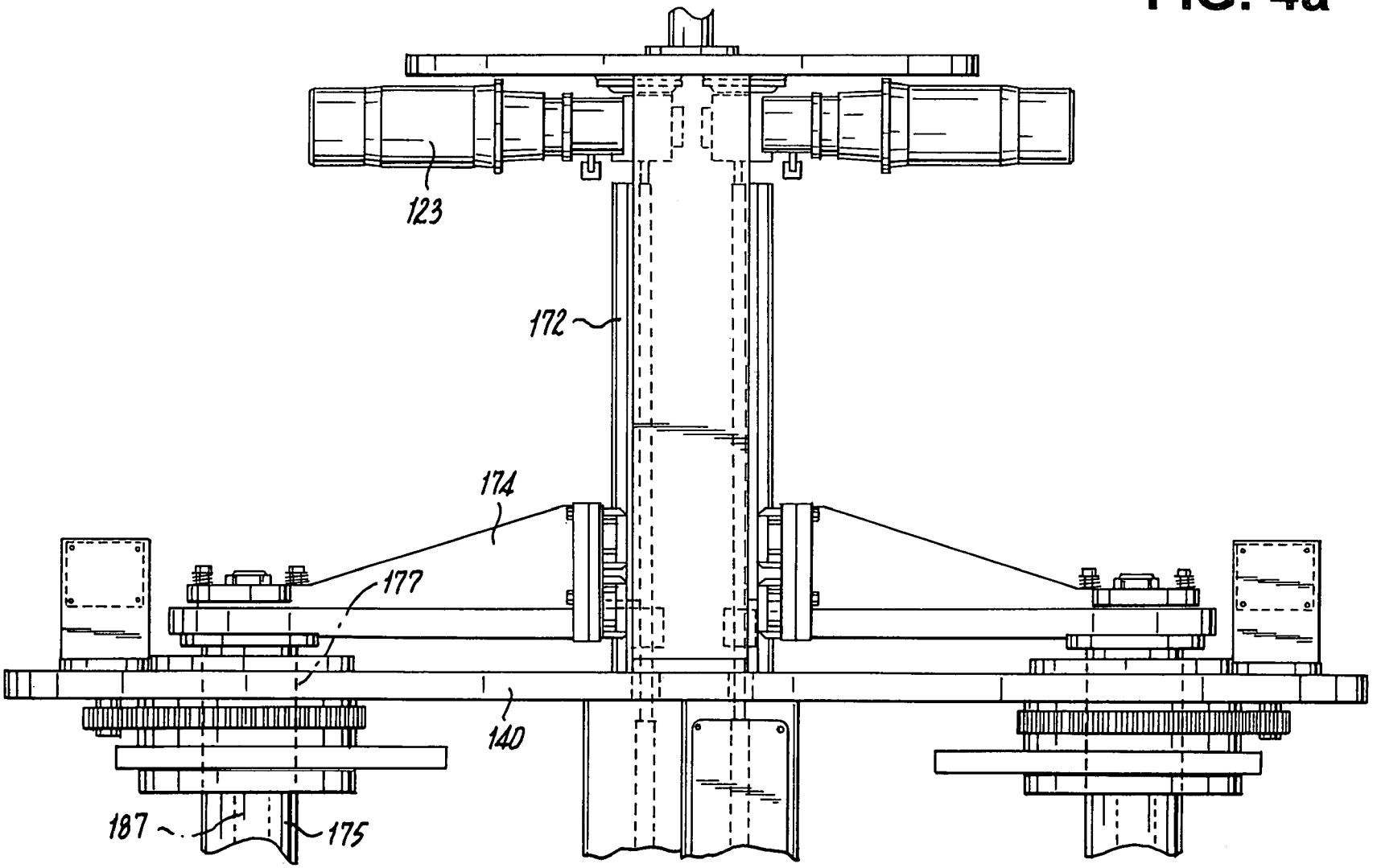
FIG. 4A is a top view of one end section of the winder of FIG. 1 illustrating a mandrel positioning assembly in a first position.
Figure 4B:
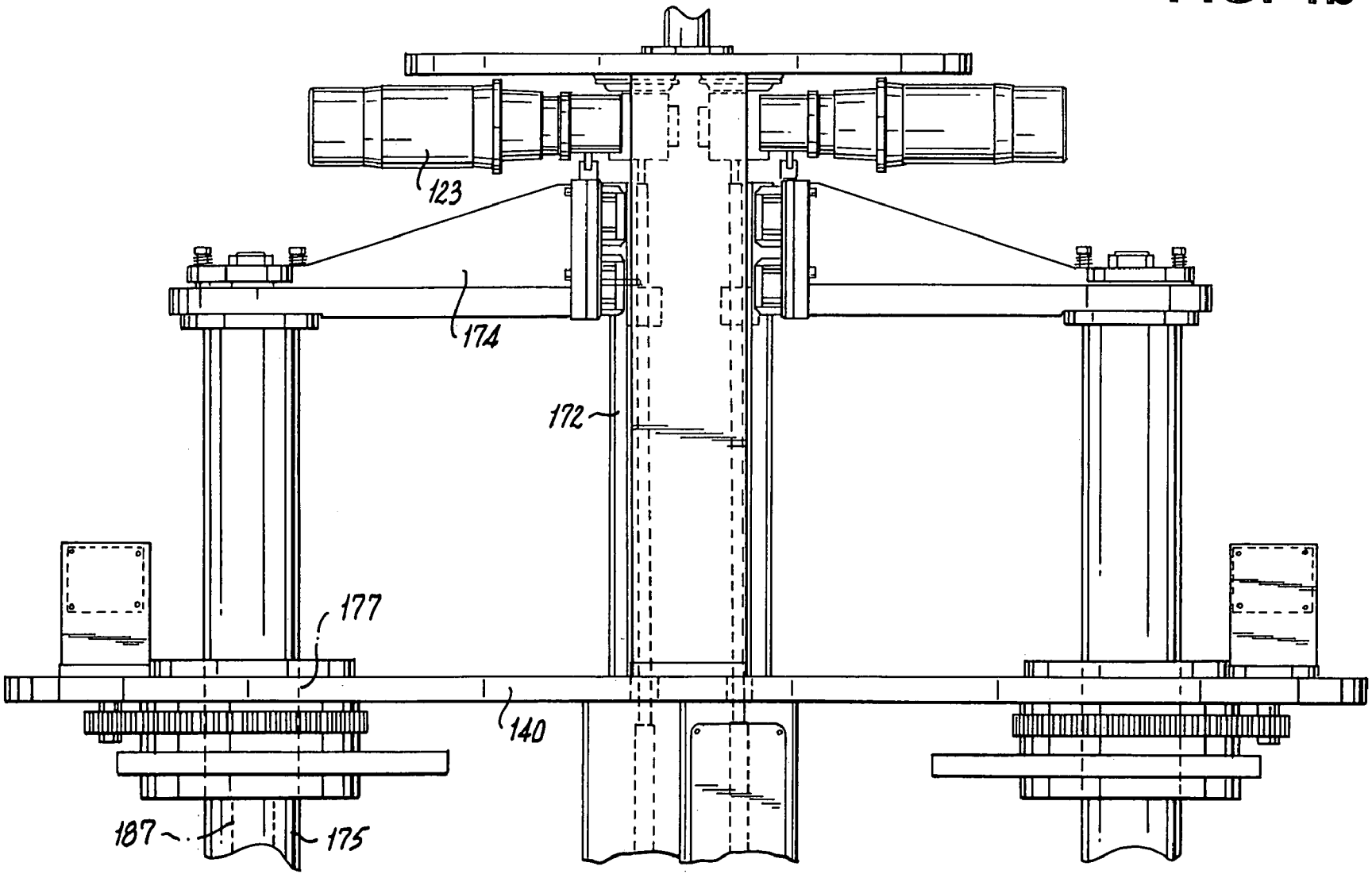
FIG. 4B is a top view of the mandrel positioning assembly in a second position.

Each end support member 140 includes a number of guide rolls 151 to assist in routing and handling of the web material 103 as it is received and processed by the winder 100. The number of guide rolls 151 can vary. In the illustrated embodiment, each end support member 140 includes four guide rolls 151 that are arranged in two pairs. More specifically, there are two guide rolls 151 positioned near each cross support member 150; and in particular, the two guide rolls 151 of one pair are arranged on opposite sides of the cross support member 150. The guide rolls 151 are rotatably mounted relative to the end support members 140. As illustrated in FIG. 1, the bumper roll assembly 120 can also include one or more guide rolls 151 to assist in the routing of the web material 103 and to better control the feed of the web material 103 into the winding components or to one or more guide rolls 151 mounted to the end support member 140.

According to the present invention, there are a plurality of pack roll support assemblies 190 that are supported concentrically with and by the respective spindle bearing housings 175 which extend through the openings 177 formed in the end support members 140. The pack roll support assemblies 190 are disposed between the end support members 140 and are concentrically mounted relative to the winding mandrels 101. The pack roll support assembly 190 has a pack roll 200 associated therewith that is freely movable along the length of the pack roll support assembly 190 so as to permit a predetermined amount of pressure to be applied to the web material 103 as it winds around the core disposed on the winding mandrel 101. The action of the pack roll 200 is described in detail below.

It will be appreciated that there are two pack roll support assemblies 190 per one winding mandrel 101, with the assemblies 190 being disposed generally at or near the ends of the winding mandrel 101. Thus, in the illustrated embodiment, there are a total of four support assemblies 190.

The exemplary pack roll support assembly 190 that is illustrated includes a pack roll support member 192 that can be in the form of a plate or the like. The support member 192 includes an opening 194 for receiving the spindle bearing housing 175 (whose ends are coupled to and support the winding mandrel 101) and thus, the support member 192 is rotatable relative to and about the spindle bearing housing 174. A first drive gear 195 is coupled to the support member 192 such that it is concentric with the opening 194 and therefore is axially aligned with the opening 177 formed through the adjacent end support member 140. The support member 192 also includes ball bushing slides 196 that are mounted to the support member 194. Each slide 196 is an elongated member that serves as a guide track and is disposed along one edge of the support member 194. The slides 196 are thus spaced from one another so as to form a gap or space 197 therebetween.

As previously mentioned, the pack roll support assembly 190 is rotatable relative to the spindle bearing housing 175 and in one exemplary embodiment, the assembly 190 is rotated in a controlled manner by a motor 199 or the like. The motor 199 is coupled to the support member 192 such that the support member 192 is easily rotated about the spindle bearing housing 175. In the illustrated embodiment, the drive mechanism is of a pinion and gear type and more specifically, the motor 199 is coupled to a pinion gear 198 that is complementary to and engages the first drive gear 195 to cause the controlled rotation of the respective pack roll support assembly 190. The motor 199 can be securely mounted to one of the end support member 140.

The motors 199 are all preferably in communication with a master controller so that the activation and stoppage of the motors 199 are easily controlled and can be part of a programmed stage operation of the winder 100. By operating the motors 199, the pack roll support assembly 190 is rotated into various positions during the winding action and operation of the winder 100 as will become apparent hereinafter.

The pack roll 200 itself is positionable relative to and is capable of being driven along the length of the support member 194 by means of a pack roll positioning assembly 210 and a corresponding actuator 220. The pack roll positioning assembly 210 includes a drivable carriage 230 that securely mates with the support member 192, and more particularly, the slides 196 thereof, to permit the carriage 230 to move along the support member 194. For example, the carriage 230 includes features 232 that engage and ride within the opposingly spaced slides 196 to provide controlled movement of the carriage 230 with translates into controlled movement of the pack roll 200 both toward and away from the winding mandrel 101 that is supported between the spindle bearing housings 175. The actuator 220 is the means which drives the carriage 230 along the length of the support member 192. In one exemplary embodiment, the actuator 220 is a rotatable screw drive mechanism which includes a motor 234 or the like and a rotatable drive screw 236 that is operatively coupled at one end to the motor 234 and at the other end, the drive screw 236 is operatively coupled to the carriage 230. The present arrangement operates like other drive screw mechanisms in that the operation of the motor 234 is translated into a driving action of the drive screw 236 which in turn is translated into the carriage 230 being driven along the support member 192 either toward or away from the winding mandrel 101. The drive screw 236 threadingly mates with a fixed nut or the like on the underside of the carriage 230 to cause advancement of the carriage 230.

The motor 234 is preferably in communication with the master controller and is configured so that the distance the carriage 230 travels is correlated to the time that the motor 234 is running. In other words, the motor 234 and master controller can be configured so that the motor 234 is operated for a predetermined amount of time each time the motor 234 receives a signal for activation thereof. Each time the motor 234 is operated for the same amount of time (elapsed time), the carriage 230 is driven the same distance along the support member 192 away from the winding mandrel 101. Alternatively, the motor 234 can be configured to run at a predetermined speed that corresponds to a given movement in a unit of time. When the carriage 230 is driven towards the mandrel 101, it can be drive continuously driven forward without any limitations on the time that the motor is activated.

The pack roll positioning assembly 210 also includes a mechanism that causes movement, via pivot or other method, of the pack roll 200 to cause incremental adjustments of the pack roll 200 relative to the winding mandrel 101. According to one exemplary embodiment, the carriage 230 includes a pneumatic cylinder 240 for causing pivotal adjustment of the pack roll 200. The cylinder 240 is pivotally attached to the carriage 230 by means of a mount 242 which permits the pivotal action of the cylinder 240. The cylinder 240 includes an extendable and retractable shaft 244 that is coupled at a distal end to a pivot arm 250. The pivot arm 250 is pivotally mounted to the carriage 230 by means of pivot block 252 and pivot bearing 254 such that the pivot arm 250 pivots about the pivot bearing 254 which acts as a pivot point for the arm 250. It will be appreciated that the pack roll 200 itself is attached to the pivot arm 250 and therefore, the pivoting action of the arm 250 is directly translated into pivoting movement of the pack roll 200.

In the illustrated embodiment, the retraction of the shaft 244 within the cylinder 240 causes the pivot arm 250 to rotate in a clockwise direction about the pivot bearing 254. This results in the pack roll 200 also being rotated in the clockwise direction such that the pack roll 200 is slightly urged forward toward the mandrel 101. Conversely, when the shaft 244 is extended outwardly from the cylinder 240, the pivot arm 250 rotates in a counterclockwise and this results in the pack roll 200 being drawn back from the winder mandrel 101.

As previously mentioned, the pack roll 200 is designed to apply a constant, pre-selected amount of pressure on the web material that is being wound around the core on the mandrel 101. The positioning assembly 210 includes a pressure regulator 260 to control the pressure between the winding roll (winding web material) and the pack roll 200 as the winder 100 is operated and the web material is continuously wound around the core. Since the cylinder 240 is preferably of a pneumatic type, the regulator 260 acts to bleed air out when the cylinder 240 operates in an effort to maintain a substantially constant amount of pressure (the pre-selected pressure) between the pack roll 200 and web as it winds around the core.

The positioning assembly 210 also includes a feedback device, such as a limit switch 270, that acts as a trigger for generating a signal that is delivered to the motor 234 to cause the motor 234 to be driven for the programmed time period or speed and this results in the carriage being driven a predetermined distance either away from or towards the mandrel 101. As will be described in greater detail hereinafter, as the winding roll grows as the web material is wound around the core, the diameter of the winding roll is continuously increasing and therefore, in order for the pack roll 200 to remain in constant contact at a constant pressure with the winding roll, the pack roll 200 is required to pivot rearward to accommodate the growing winding roll. The use of the pivot arm 250 and cylinder 240 permit such pivoting action of the pack roll 200 and the regulator 260 which is operatively connected to cylinder 240 controls the pressure between the winding roll and the pack roll 200 so that a substantially constant pressure is always applied between these two members. However, the cylinder 240 only has a limited stroke to cause pivoting of the arm 250 and therefore, once the cylinder 240 approaches the end of its stroke, the pack roll 200 nears the end of its pivoting action. In order to permit further pivoting of the pack roll 200, the positioning assembly 210 needs to be adjusted accordingly. More specifically, as the pivot arm 250 approaches the end of its pivoting action due to the cylinder 240 approaching the end of its stroke, the pivot arm 250 strikes or otherwise triggers the limit switch 270 or other device which in turn causes a signal to be sent to motor 234 to back the carriage 230 rearward.

As the carriage 230 is backed rearward away from the mandrel 101, the pack roll pivot 254 is likewise moved away from the mandrel 101; however, the cylinder 240 and the regulator 260 are configured so that the pack roll 200 always is in contact with the winding roll at a predetermined pressure. Thus, as the carriage 230 is being driven backwards, the shaft 244 of the cylinder 240 begins to retract into the cylinder 240 and this causes the pivot arm 250 to pivot in a clockwise direction which results in the pack roll 200 being slightly urged towards the winding mandrel 101 to ensure that the pack roll 200 remains in contact with the winding roll even when it is being driven away from the winding roll due to movement of the carriage 230 in a direction away from the winding mandrel 101. As previously mentioned, once the motor 234 is actuated, it operates for a preset, programmed period of time or speed resulting in the carriage 230 being driven an incremental distance that is preset by the user through the master controller. After the preset time period expires, the carriage 230 stops in its new position and the winding roll continues to grow causing rearward pressure to be applied and the above described action of the cylinder 240 starts over. Alternatively, the system can be programmed through the master controller so that the carriage 230 is driven at a constant speed maintaining the cylinder shaft 244 at a fixed position, thus maintaining a constant pack pressure. It will be appreciated that such clockwise pivoting of the pivot arm 250 and retraction of the cylinder shaft 244 resets the limit switch 270 and the process starts over with the shaft 244 slowly extending to cause counterclockwise pivoting of the pivot arm 250. It will be appreciated that any number of alternative type of devices can be used in place of the limit switch. For example, a proximity switch can be used in place of the limit switch.

Still referring to FIGS. 1–5, the insertion of one winding mandrel 101 and a core thereabout and operation of the winder 100 are described in detail below. The motor 123 is operated so as to cause rotation of one drive screw 117 which results in the spindle supports 174, associated therewith, being driven along the axis of the drive screw 117 such that the spindle bearing housings 175 separate from one another a sufficient distance to permit insertion of the winding mandrel 101 therebetween. The mandrel 101 is in the form of an elongated support member or core or the like that can take any number of different forms as described below.

In one embodiment, a spindle plug 299 is coupled to the second end 191 of the spindle drive shaft 187 at or near the second bearing 197. The spindle plug 299 can be of the type that is referred to as an "inflatable chuck" in that the spindle plug 299 can be inflated with air to cause the expansion thereof. Since the spindle plug 299 is coupled to the mandrel drive shaft 187, the input port 161 is in communication with the spindle plug 299 and air can be pumped into the input port 161 and delivered to the spindle plug 299 for inflation thereof. The spindle plug 299 is configured to be received within the ends of the mandrel 101 such that a snug frictional fit results therebetween. The spindle plug 299 is securely attached to the spindle drive shaft 187 such that the two rotate together as a single member and therefore, the rotation of the spindle drive shaft 187 is directly translated to rotation of the mandrel 101 supported by and extending between the spindle plugs 299.

In another embodiment, the mandrel 101 can be of the type that has a central bore formed therethough from one end to the other end such that it is configured to receive an expandable shaft member 127 that is coupled and securely attached at its ends to respective spindle bearing housings 175. More specifically, the shaft member 127 is securely attached at its ends to the second bearings 197 and as a result, there is direct coupling between the shaft member 127 and the mandrel drive shaft 187. The rotation of the spindle drive shaft 187 is therefore translated into rotation of the mandrel 101.

In this embodiment, the expandable shaft 127 is inserted into the central bore of the mandrel 101 so that it extends beyond the ends of the mandrel 101 to permit the ends of the shaft 127 to be coupled with the spindle drive shaft 187 within the spindle bearing housings 175. The expandable shaft 127 is operatively coupled to an air source which serve to expand the shaft 127 within the central bore of the mandrel 101 such that a tight fit results therebetween. As a result of this fit, the expandable shaft 127 and the mandrel 101 rotate as a single member.

Referring to FIGS. 6–17, the normal operation of the winder 100 is as follows. FIG. 6 illustrates an initial winding position when the turret is operating in the under mode where the web material 103 is winding on the core (first winding roll) that is coupled to the right mandrel 101. As can be seen, the web material 103 is fed by the idler rolls (guide rolls) 151 that are associated with both the bumper roll assembly 120 and the end support members 140. The roll changer 110 is moved along the guide tracks of the base 102 so that it assumes that the bumper roll assembly 120 is brought into close proximity to a new core that is disposed about the left winding spindle 101. More specifically, the bumper roll 122 is brought into a 9 o'clock position relative to the new core. The bumper roll 122 is spaced from the new core to permit the web material 103 to travel therebetween as it is guided downstream by the idler rolls 151 to the pack roll 200 which guides the web material 103 onto the first winding roll as it rotates about the right winding mandrel 101. As explained earlier, the pack roll 200 applies pressure to the roll (i.e., the right winding roll) that is being wound at the location where the web material is laid onto the underlying rolled web material. The new core (second winding roll) is coated with an adhesive or is wrapped with double sided adhesive tape or is otherwise treated so that it has adhesive properties such that when the web material 103 is placed in contact therewith, the web material 103 adheres thereto and begins to wrap around the new core as it is wound.

The terms left and right are merely used for descriptive and illustrative purposes to more easily convey the location of the various components during various stages of the winding operation. It will therefore be appreciated that the first winding core can be coupled to the left mandrel 101 as opposed to the right mandrel 101 as described above. In addition, the spindle that is referred to as the right mandrel can be referred to as a left mandrel depending upon the point of reference and vice versa.

Figure 5:
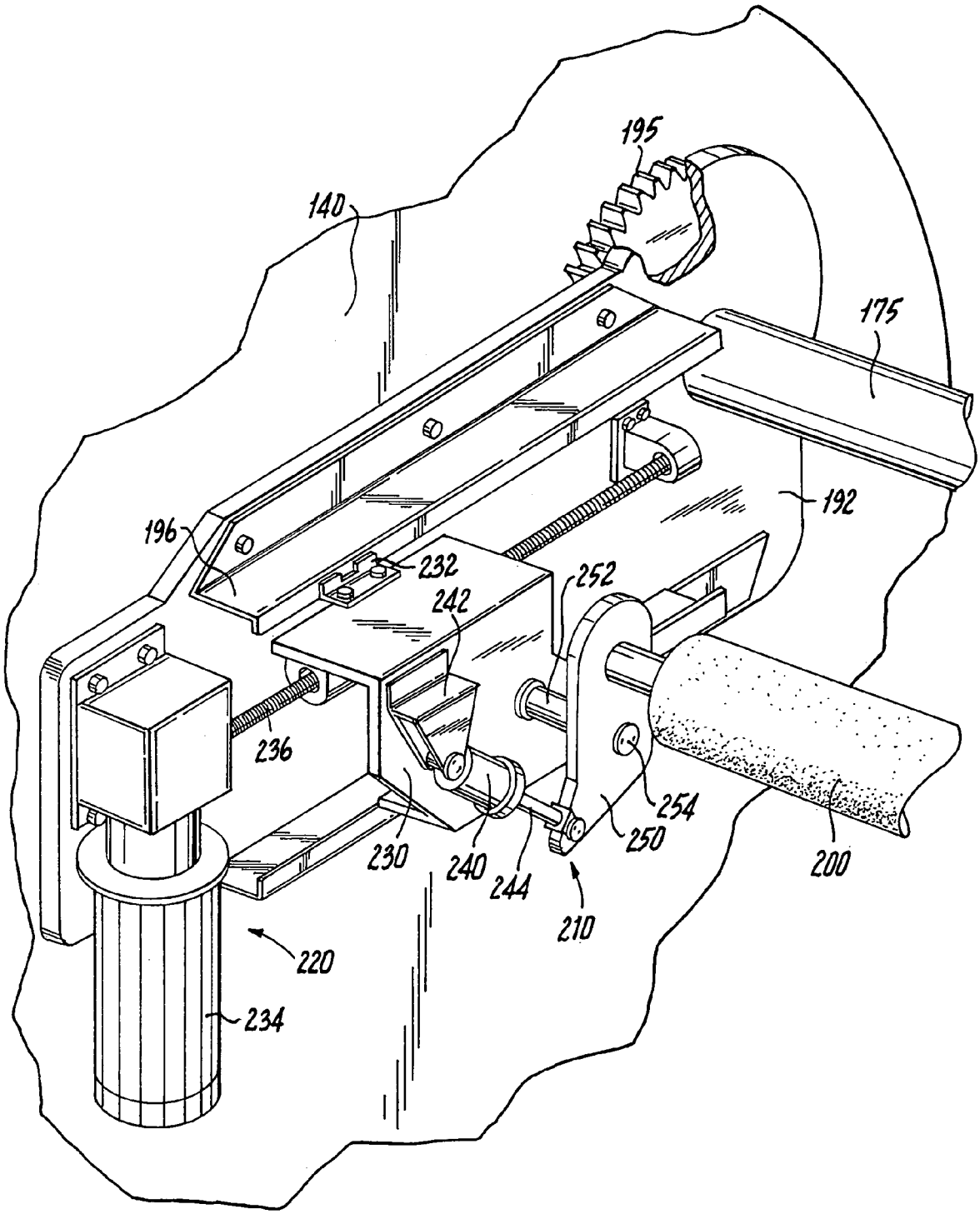
FIG. 5 is a partial perspective view of a pack roll support and positioning assembly.

When the pack roll supply assemblies 190 are in positions that generally outline a "V" shape, this is indicative of one of the pack roll assemblies 190 being in a winding position and the other being in a transfer position. In FIG. 5, the pack roll assembly 190 that is associated with and rotatable about the right mandrel 101 is in the winding position, while the pack roll assembly 190 that is associated with and rotatable about the left mandrel 101 is in the transfer position. In the illustrated position, the pack roll assembly 190 that is disposed about the right mandrel 101 is in the 7 o'clock position (winding position), while the pack roll assembly 190 that is disposed about the left mandrel 101 is in the 4 o'clock position (transfer position).

The pack roll positioning assembly 210 is operated so that the pack roll 200 is brought into close proximity but not contact with the new core since the new core has adhesive characteristics. The cylinder 240 that is mounted to the carriage 230 of the left pack roll positioning assembly 210 is positioned so that the shaft 244 is not retracted and therefore, the pack roll 200 thereof is not fully rotated clockwise about the pivot 254 and therefore is backed slightly away from the new core.

Figure 7:
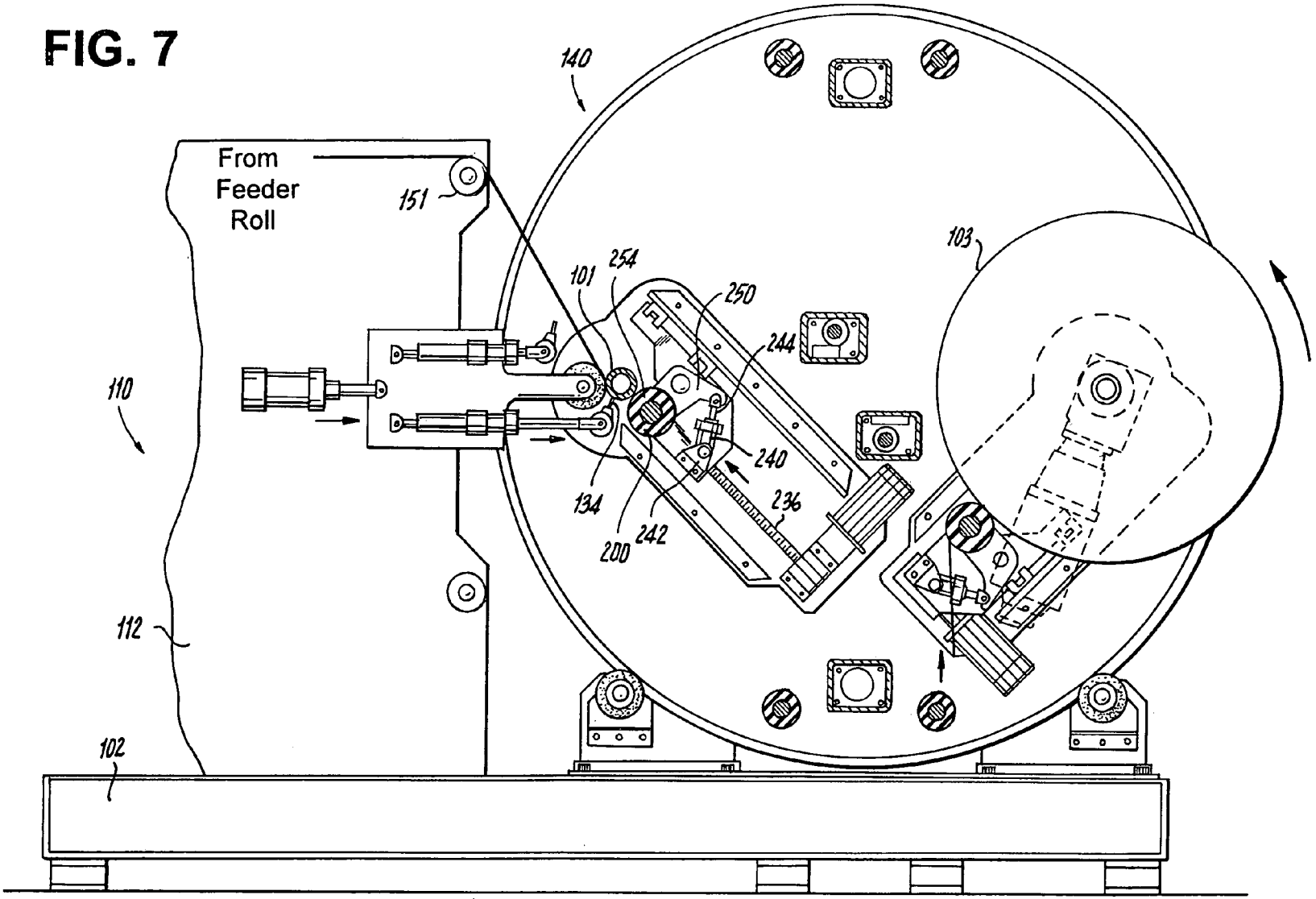
FIG. 7 is a side elevation view of the winder of FIG. 6 indexed to a second position where winding is initiated on a second winder roll as a result of the firing of a bumper roll and cutter assembly.

FIG. 7 illustrates the winder 100 in a second position following the first position where a transfer operation has taken place. In this position, the bumper roll assembly 120 is actuated such that the actuator 124 is fired causing the bumper roll 122 to rapidly advance toward the new core and is it does this, the bumper roll 122 strikes the web material 103 and drives the web material 103 into contact with new core. The adhesive or the like on the new core causes the web material 103 to adhere thereto and since the new core is rotating with the left spindle 101, the web material begins to wind around the new core. Subsequent to the firing of the actuator 124, one of the actuators 136 is fired so that a corresponding one of the knives 132, 134 (e.g., second knife 134) moves and rotates toward the new core and cuts the tensioned web material at a location downstream of the new core so that the web material 103 downstream of the new core and the point of impact with the bumper roll 122 can continue to advance and be guided by the idler rolls 151 and pack roll 200 to the first winding roll (right roll) for completion of the winding operation at the first winder roll. The cylinder 240 that forms a part of the carriage 230 that is positioned proximate the new core at the left winding mandrel 101 is then activated so that the shaft 244 is retracted causing the pivot arm 250 to pivot clockwise about the pivot 254, thereby driving the pack roll 200 slightly toward the new core and into contact with the web material. As previously mentioned, the pressure regulator 260 works in conjunction with the cylinder 240 to ensure that a predetermined amount of pressure is always exerted by the pack roll 200 against the web material 103 that is being wound around the new core.

It will be appreciated that the pack roll 200 has been brought into contact with the second winding roll; however, the pack roll 200 is not yet in contact therewith at the tangential position which is the 9 o'clock position where the fresh web material makes first contact with the second winding roll due to the bumper roll 122 being in this same position.

Figure 8:
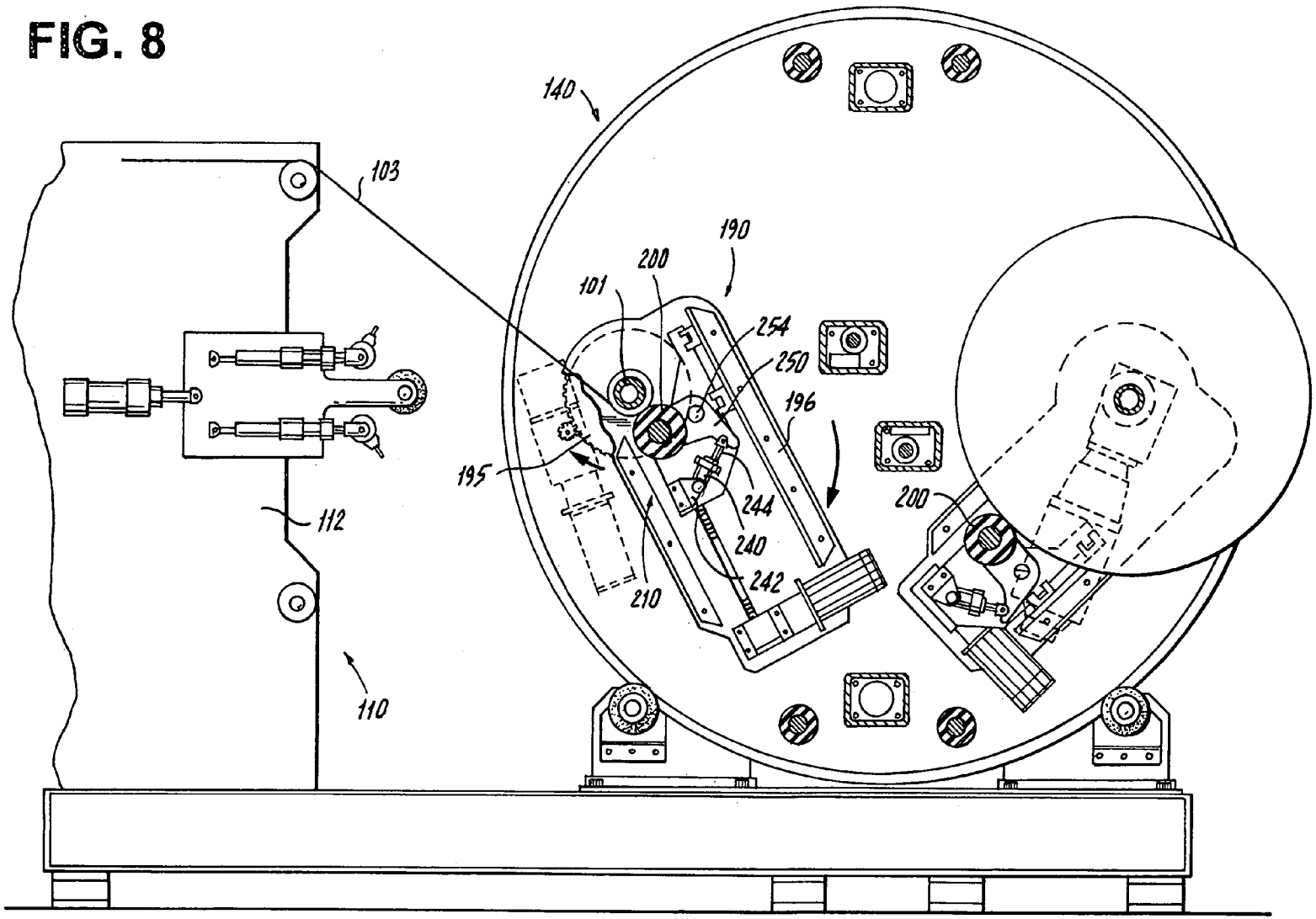
FIG. 8 is a side elevation view of the winder of FIG. 6 indexed to a third position where a bumper roller and cutter assembly has been retracted.

FIG. 8 shows the roll changer 110 retracted on the guide tracks of the base 102 away from the first winding roll. The retraction of the roll changer 110 and more particularly, the bumper roll assembly 120 thereof, opens up the tangential position (9 o'clock position) for movement of the pack roll support assembly 190 thereto. In order to accomplish this, the motor 199 is actuated to cause rotation of the pinion gear 198 which in turn is translated into rotation of the first drive gear 195 resulting in rotation of the support member 192 about the left mandrel 101 toward a location where the pack roll 200 is in the 9 o'clock position.

In FIG. 8, the winding of the first winding roll is completed and therefore, the first winding roll is ready for removal from the right mandrel to allow a new core to be inserted and coupled to the right mandrel 101. In other words, the motor driving the right mandrel 101 is stopped to permit the operator to remove the completed first winding roll. The ability of the operator to easily remove and insert a new core at the winder position illustrated in FIG. 8 is one advantage offered by the present winder 100 compared to conventional winders and in particular, compared to the winder disclosed in the previously discussed '140 patent. As previously discussed, the winder in the '140 patent suffers from the disadvantage that a new core can not be loaded at the same location where a finished, full roll is unloaded and removed.

It will also be appreciated that as the winding is taking place at the second winding roll, the positioning assembly 210 is continuously monitoring and operating to ensure that the pack roll 200 associated therewith is always kept in contact with the second winding roll at substantially the same preset, programmed pressure. The movement of the positioning assembly 210 is independent from the movement of the pack roll support assembly 190 and therefore, even when the pack roll support assembly 190 is rotated about the left mandrel 101, the positioning assembly 210 is operated to ensure the constant contact between the pack roll 200 and the second winding roll. As previously discussed, as the first winding roll grows, the pack roll 200 pivots backward in a counterclockwise direction about the pivot 254 to permit the first winding roll to increase in diameter. However, as the shaft 244 approaches the end of its stroke, the pivot arm 250 contacts and trips the limit switch 270. Once the limit switch 270 trips, the motor 234 is actuated for the predetermined period of time or speed to cause rotation of the drive screw 236 which mates with the threaded nut that forms an integral part of the carriage 230 resulting in the carriage 230 being driven for the predetermined period of time in a direction away from the second winding core. As the carriage 230 is driven away from the second winding core, the shaft 244 begins to retract into the cylinder 240 to cause clockwise movement of the pivot arm 250 resulting in the pack roll 200 pivoting toward the second winding roll, thereby ensuring that the pack roll 200 remains in contact with the second winding roll as it grows.

Figure 9:
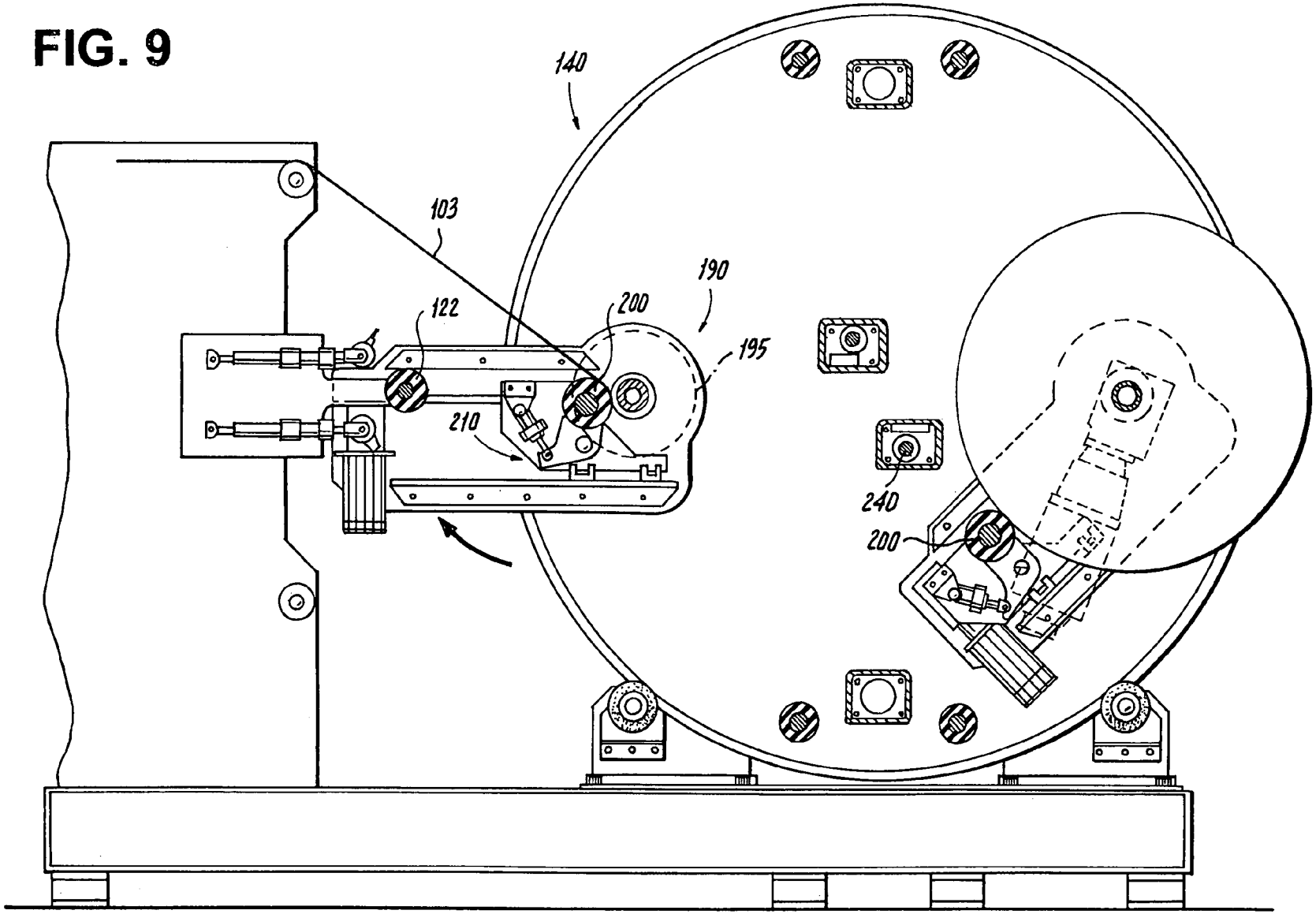
FIG. 9 is a side elevation view of the winder of FIG. 6 in a fourth position illustrating the rotation of a lay-on roll assembly about the second winder roll.

FIG. 9 illustrates a position where the pack roll support assembly 190 has been rotated to a position where the pack roll 200 is in the tangential position (9 o'clock position). In this position, the pack roll positioning assembly 210 associated with the completed first winding roll is retracted so that the pack roll 200 thereof is spaced from the finished first winding roll to permit removal of the finished first winding roll and insertion of a new core onto the right mandrel 101.

Figure 10:
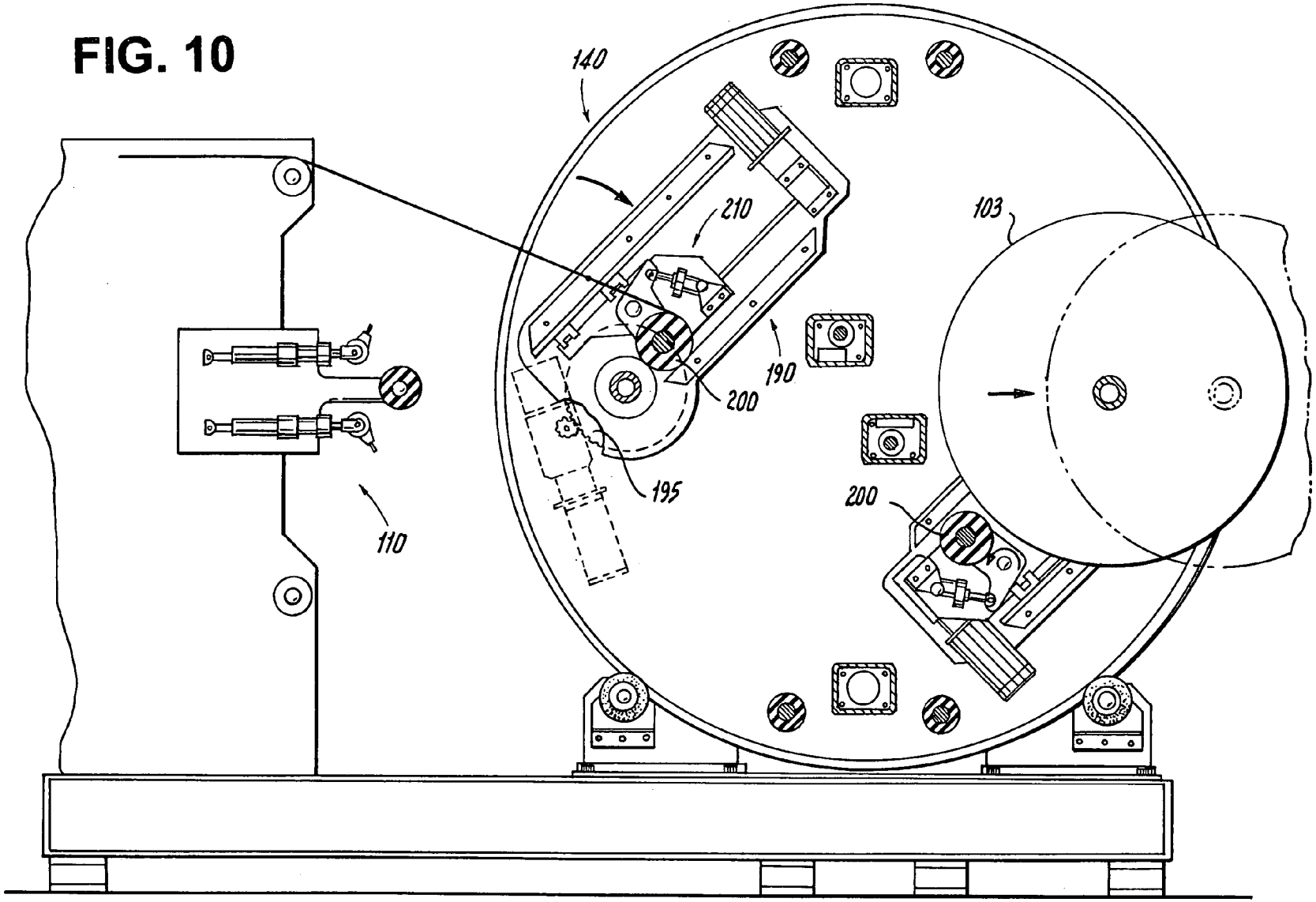
FIG. 10 is a side elevation view of the winder of FIG. 6 in a fifth position illustrating continued rotation of the lay-on roll assembly about the second winder roll and removal of the first winder roll.

FIG. 10 illustrates the pack roll support assembly 190 rotated about the second winding roll so that it assumes a winding position (e.g., 2 o'clock position). In the winding position, the pack roll support assembly 190 disposed about the second winding roll is symmetrically orientated relative to the pack roll support assembly 190 disposed about the first winding roll. FIG. 10 also shows removal of the finished first winding roll from the right mandrel 101 to permit insertion of a new core thereon.

Figure 11:
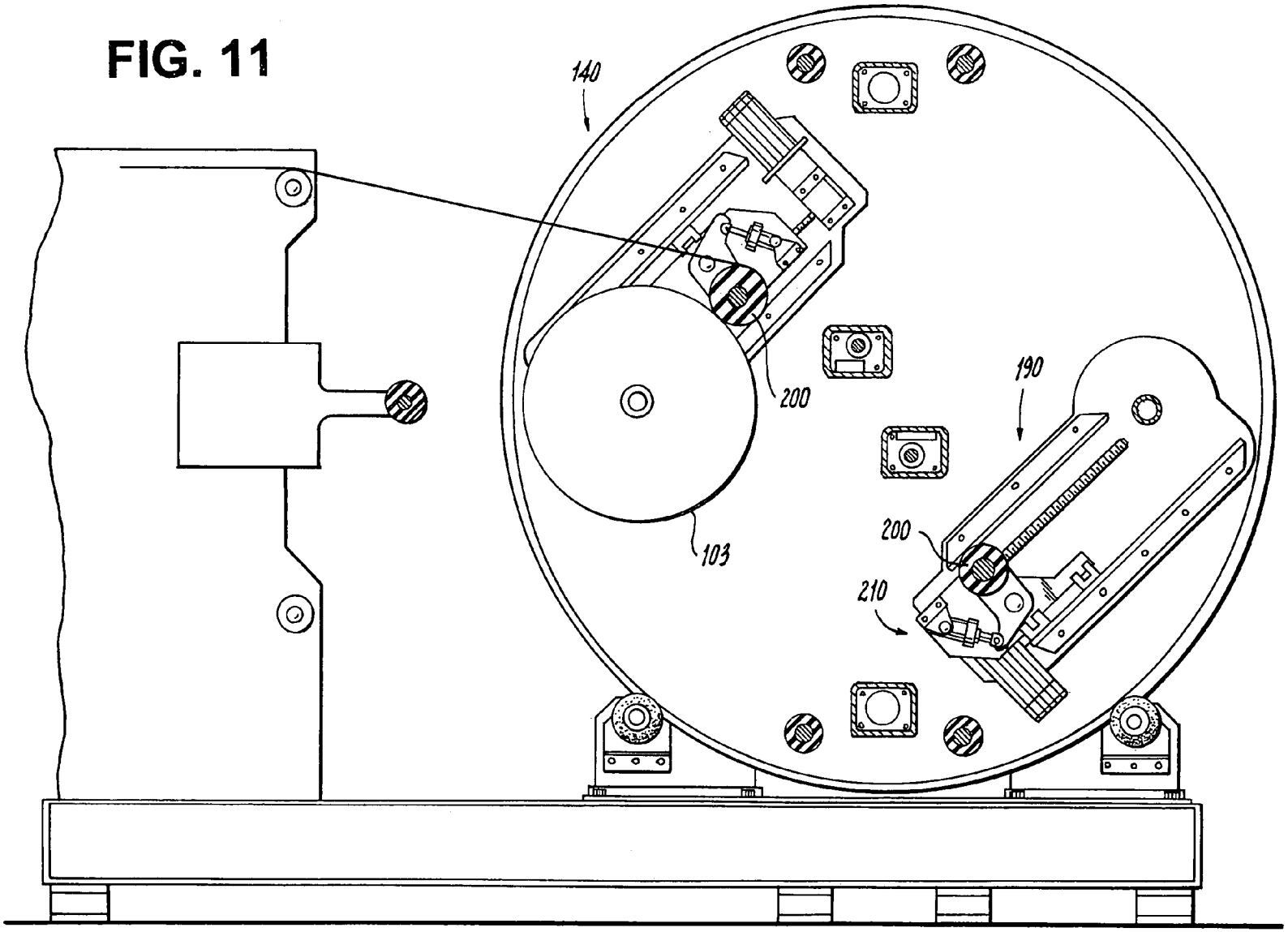
FIG. 11 is a side elevation view of the winder of FIG. 6 in a sixth position illustrating the continued winding of the second winder roll and rearward advancement of the lay-on roll assembly.
Figure 12:
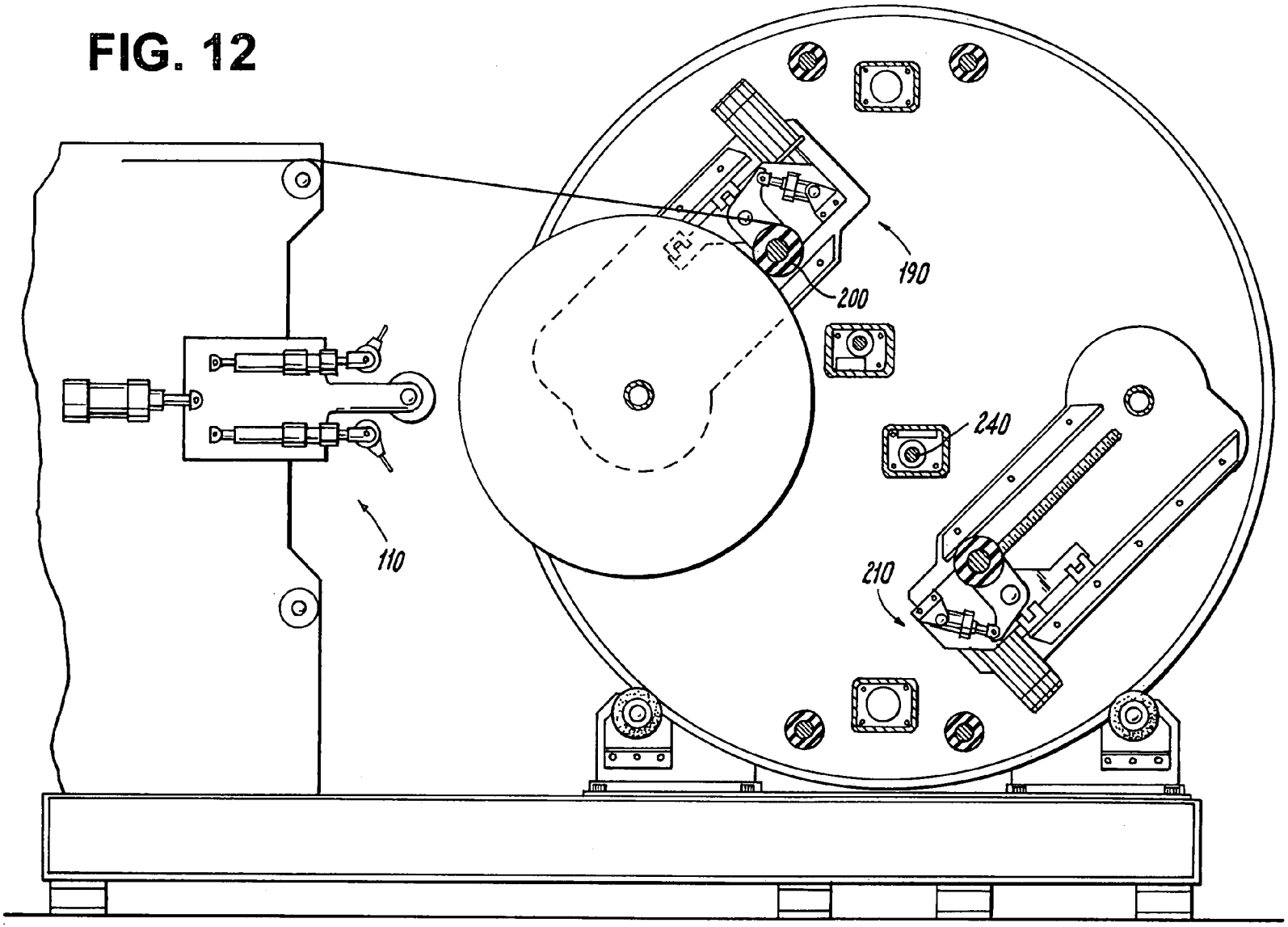
FIG. 12 is a side elevation view of the winder of FIG. 6 in an seventh position illustrating further winding and rearward advancement of the lay-on roll assembly.

FIG. 11 shows the winder 100 with the finished first winding roll removed and the second winding roll growing in size. The carriage 230 associated with the pack roll support assembly 190 about the second winding roll is retracted rearward away from the left mandrel 101, compared to the position in FIG. 10, as the second winding roll increases in diameter. The continued interactive cooperation and operation of the pressure regulator 270 and the pack roll positioning assembly 210 ensures that the pack roll 200 remains in contact with the second winding roll at a constant pressure even as the carriage 230 travels along the ball busing slides 196. FIG. 12 shows continued winding of the second winding roll and further retraction of the carriage 230 along the ball busing slides 196 as the carriage 230 nears the end of its permitted length of travel. The other carriage 230 still remains in the retracted position.

Figure 13:
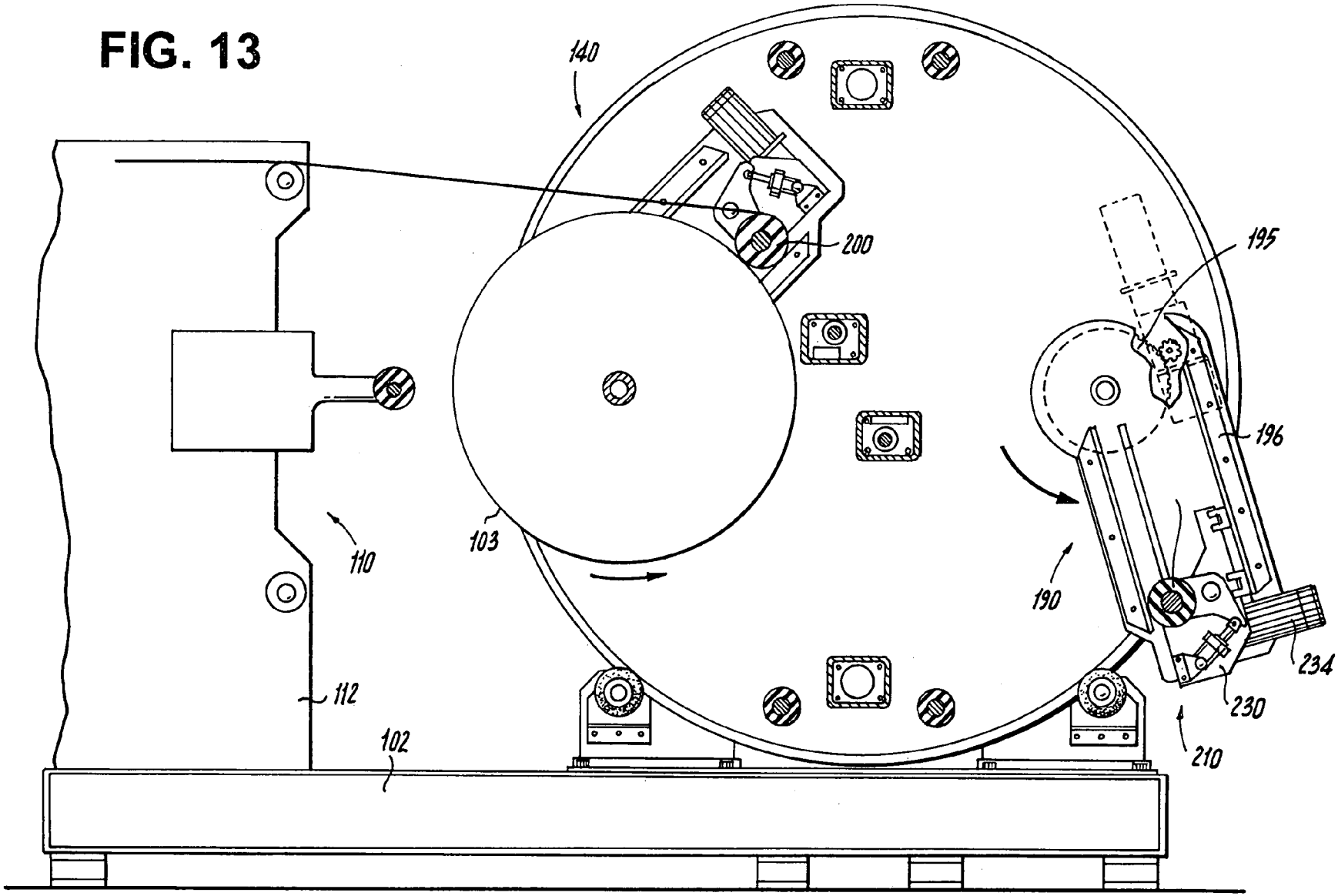
FIG. 13 is a side elevation view of the winder of FIG. 6 in a eighth position illustrating rotation of a lay-on roll assembly associated with the first winder roll.
Figure 14:
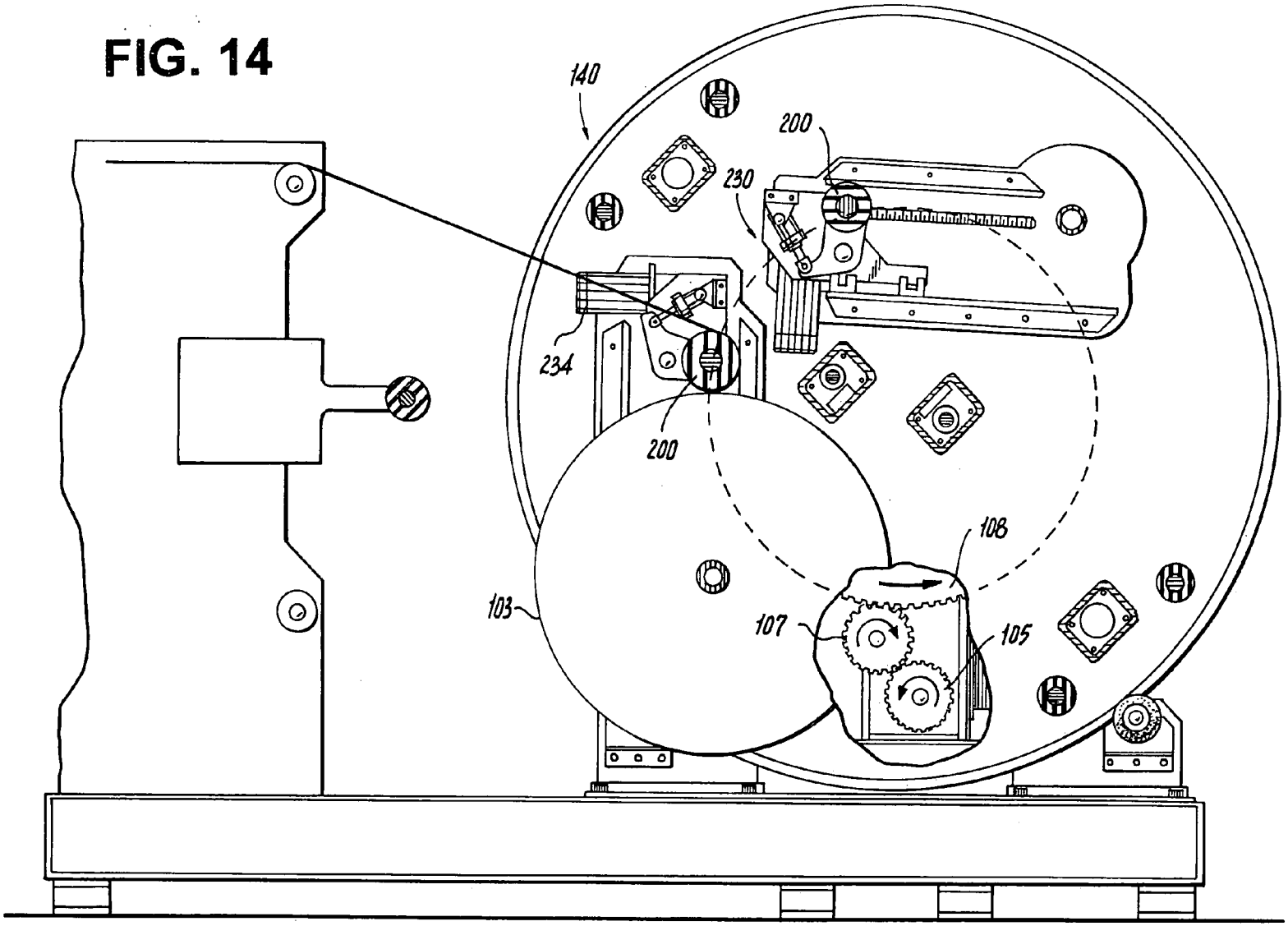
FIG. 14 is a side elevation view of the winder of FIG. 6 in a ninth position illustrating initial rotation of the turret-type winder.

FIG. 13 illustrates the continued winding of the second winding roll. In this position, the other pack roll support assembly 190 is rotated by operation of the motor 199 about the right mandrel 101 (and the new core supported thereby). This other pack roll assembly 190 is rotated to its transfer position so that it can accept the web material to begin winding of the web material on the new core that is supported by the right mandrel 101. FIG. 14 illustrates the beginning of the rotation of end support members 140 in a counter clockwise direction, as well as all of the components mounted directly or indirectly thereto.

Figure 15:
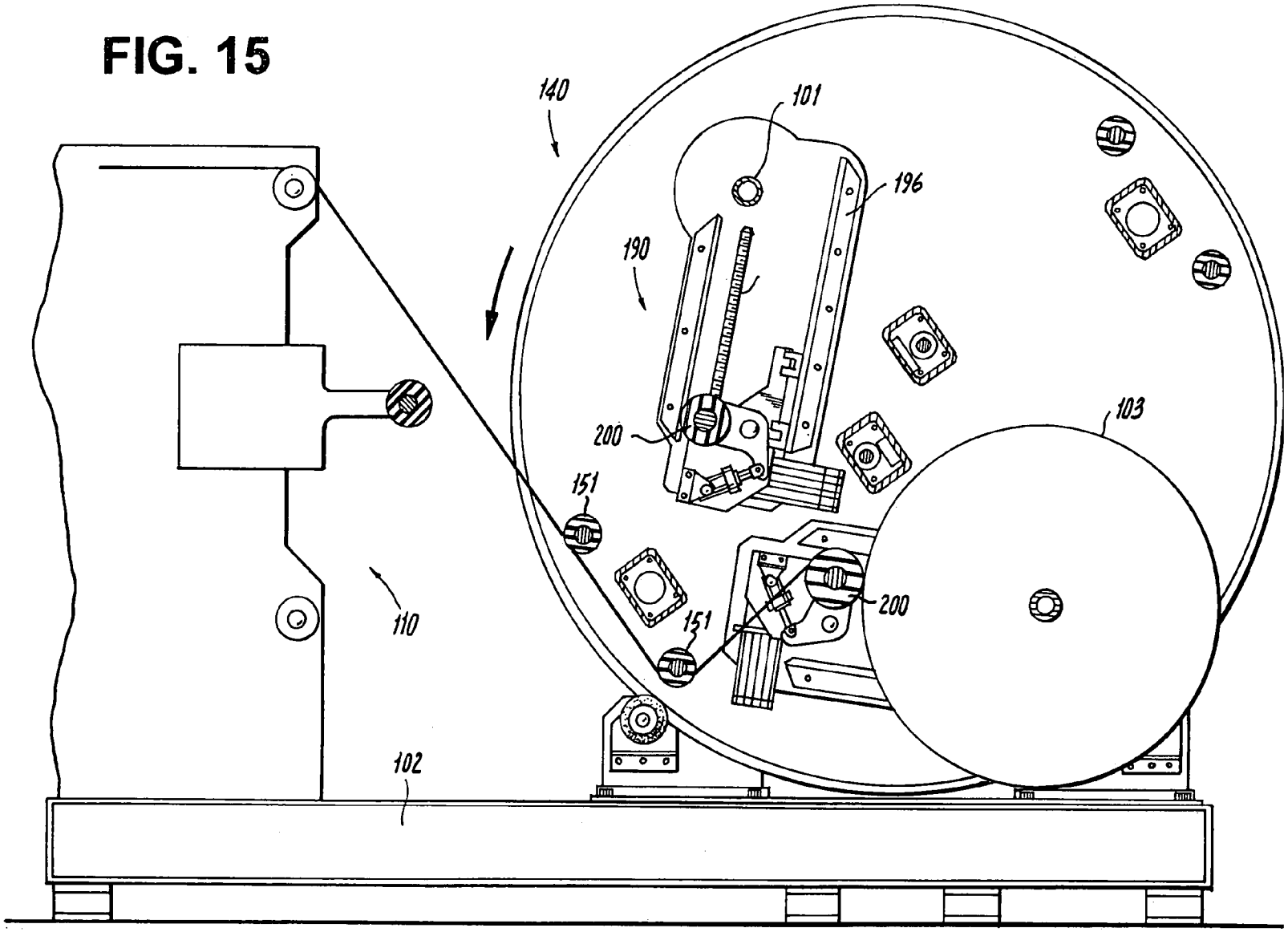
FIG. 15 is a side elevation view of the winder of FIG. 6 in an tenth position illustrating continued rotation of the turret-type winder.

FIG. 15 illustrates further rotation of the end support members 140 and it will be appreciated that as the end support members 140 rotate so that the winding location moves from the left winding location to the right winding location (180 degrees apart), the web contacts and is guided by idler rolls 151 such that the web is continuously fed right to the pack roll 200 which maintains the constant pressure on the web as it winds about the core. The pack roll support assemblies 190 are still in a generally "V" shape indicating that one support member 194 is in the transfer mode, while the other support member 194 is in the winding mode.

In FIG. 16, the end support arms 140 have been rotated 180 degrees from the initial winding position shown in FIG. 6 resulting in winding taking place in the right side location with the second winding core having been rotated 180 degrees while winding is continuously taking place therearound. The pack roll 200 associated with the other core (the new core) is positioned close to but not in contact with the new core so that once the winding has been completed around the second winding core, the roll changer 110 can be actuated in the manner previously described to bring the web into contact with the new core that is positioned at the left side location. FIG. 17 shows the roll changer 110 being moved closer towards the web just prior to actuation of the bumper roll assembly 120. One will appreciate that FIGS. 6 and 17 represent and depict the identical winding environment and therefore, the process shown in FIGS. 6–17 represents one winding cycle where a completed winding roll is taken off line by initiating winding of the web on the new core to permit unloading of the completed winding roll. As winding continues on what was the new core, a new core is inserted where the completed one was removed and the winder is subsequently rotated so that the winding roll is positioned 180 degrees away from its present position as shown.

It will be appreciated and understood that a number of components depicted in the drawing figures can be interchanged with similar and like components. For example, the specific frame that supports the pack roll 200 can be modified in that the illustrated cross frame members are merely exemplary in nature and not limiting. For example, the end support members 140 do not necessarily have to be in the form of gears since the turret can be rotated using other techniques that are known in the art.

In addition, the winder 100 can be of a fixed distance type in that the spindle support assemblies 170 are eliminated since there is no need to vary the distance between members that receive and hold the winding mandrel. In this type of winder, only one size mandrel is received therein for supporting a core of one size. In this embodiment, there are still a plurality of pack roll support assemblies 190 that support the pack roll 200 and the pack roll positioning assembly 210. In this embodiment, the assemblies 190 are supported concentrically with and by the spindle bearing housings that are stationary or fixed.

Another feature of the winder 100 is that it can be operated so that it winds in the opposite direction. In other words, in the field of web converting technology, it is sometimes desirable to wind with the opposite side of the web facing out. This can be accomplished by rotating the turret arms (end support members 140) in a clockwise direction as opposed to the counterclockwise direction shown in the figures and described above and then reversing the position of the roll changer 110 by means that are known in the art of automatic winding. The rotational direction of the various winding motors is also reversed at this time. The other components operate in the same manner described hereinbefore with the pack roll 200 being placed into either a contact or gap winding mode. Thus, when the turret rotates in this clockwise direction, the winding operation results in the web being wound with a side facing out that is opposite the side facing out that is shown in the drawing figures, which illustrate an opposite embodiment. The winder in the '140 patent suffers from the disadvantage that it is limited to operation in a single direction.

It will be appreciated that sometimes in the field of web converting technology, it is sometimes desirable to wind with the opposite side of the web facing out. This can be easily accomplished by rotation of the turret assembly (including the end support member 140) in a clockwise direction as opposed to the counterclockwise direction that is shown in FIGS. 13 and 14. At the same time, the position of the bump and cut mechanism can be moved by means already known in the field of automatic winding, as for example, by an automated means in which the bump and cut mechanism can be moved along track guides or the like. The rotational direction of the winding motors is reversed at this time to cause the opposite side of the web to be wound facing out. The remaining winding steps are essentially the same as those described above with the only difference being that the winding takes place in the opposite direction. However, even in this alternate embodiment, where the winding takes place in the opposite direction, the winder operates as a continuous winder that permits pressure to be applied to the winding roll at a point of entry of the web throughout the entire winding cycle and also permits a new core to be immediately inserted at the same location where a finished roll was just removed while the winding of a new roll continues at another location.

Moreover, it will also be appreciated that the present winder 100 is suitable for use as a gap winder as opposed to a contact winder that has been described above in detail. As is known in the art, gap winding is a winding process in which there is always a space (e.g., a predetermined distance) between the pack roll and the web. In gap winding, the pack roll serves as a means to control the web right up to point where the web lays down on the core. In gap winding, it is important that the distance between the winding web and the pack roll remain substantially constant. There are a number of mechanisms that can be used to maintain and control the distance between the pack roll and the web. For example, a photo switch or proximity switch or a sonic sensor or the like can be used to maintain this gap (distance) and once the photo switch detects that the winding web has grown sufficiently such that the distance between the pack roll and the web falls outside of an acceptable range, the photo switch is tripped and causes a control signal to be generated. This control signal is responsible for the carriage being driven away from the web for a pre-selected period of time as previously described. The operation of the pneumatic cylinder and pivot arm ensure that the pre-selected distance is maintained between the pack roll and the web even while the carriage is driven away from the web.

It will further be appreciated that the pressure that is applied to the winding roll at the point of entry of the web throughout the entire winding cycle does not have to be constant pressure in the sense that the pressure applied against the winding roll is of the same value at all times throughout the winding cycle. While, it may be desirable for the same or substantially same force (pressure value) to be applied to the winding roll, it is not a requirement and in fact, the amount of pressure applied to the winding roll can be varied throughout the winding cycle so long as some pressure is applied to the winding roll at all times.

It will be appreciated by persons skilled in the art that the present invention is not limited to the embodiments described thus far with reference to the accompanying drawings; rather the present invention is limited only by the following claims.

What is claimed is:

1. A turret winder comprising:

first and second rotatable end support members;

two pairs of first and second spindle support assemblies that are movable along respective guide tracks that are disposed outside of the first and second rotatable end support members, each spindle support assembly having a spindle bearing housing that extends through an opening formed in one of the first and second end support members, each of the spindle bearing housings has a drive feature disposed therein for coupling with and for driving a spindle that supports one core for winding rolls thereon, the first and second spindle support assemblies of each pair being drivable along the guide tracks in directions both toward and away from the end support members to accommodate spindles of varying lengths; and two pairs of pack roll support assemblies that are disposed concentric with and rotatable about the spindle bearing housings, one for each spindle end, each of the pack roll support assemblies having a carriage that controllably travels along a length thereof, the carriage rotatably carrying one pack roll that is pivotably movable into contact with one core with a winding roll thereon so that a web leading onto the core from a roll changer contacts the associated pack roll at or prior to winding thereof on the winding roll for excluding entrapped air prior to forming of convolutions on the roll in a winding position.

2. The winder of claim 1, wherein each of the first and second spindle support assemblies includes a spindle support that travels along the guide tracks, the spindle bearing housing being mounted to and extending outwardly from the spindle support.

3. The winder of claim 2, wherein the drive feature is a first drive shaft that is disposed in and supported by bearings in the spindle bearing housing, the first drive shaft being rotatably driven within the spindle bearing housing with one end of the first drive shaft being coupled to the spindle such that rotation of the first drive shaft is translated into rotation of the spindle.

4. The winder of claim 2, further including:

a drive source having a first drive gear; and a main drive gear rotatably coupled to and driven by the first drive gear, wherein the main drive gear is coupled to one of the end support members such that rotation of the main drive gear is translated into rotation of both of the end support members.

5. The winder of claim 4, further including a plurality of cross support members that extend between the end support members and extend outside of the end support members, the cross support members housing a pair of spindle drive screws, one associated with each spindle support assembly, each spindle drive screw being operatively coupled to one of the spindle supports such that rotation of the spindle drive screw is translated into movement of one pair of opposing spindle supports along respective guide tracks.

6. The winder of claim 5, wherein the cross support members are arranged to form two linear cross support members that extend through openings formed through the end support members as well as each extending between the end support members.

7. The winder of claim 5, wherein a section of the cross support members are mounted to and extend between the idler gear and one of the end support members, with another section of the cross support members being mounted to and extending between the other end support member and a rotatable spindle guide support member, one pair of the guide tracks being mounted to and extending between the idler gear and one end support member, while the other pair of guide tracks being mounted to and extending between the spindle support member and the other end support member.

8. The winder of claim 1, wherein the two pairs of first and second spindle support assemblies are rotatable in unison with the end support members.

9. The winder of claim 1, wherein each of the pack roll support assemblies includes a pack roll support member on which the carriage travels in a controlled movement, the pack roll support member having an opening formed therethrough that receives one respective spindle bearing housing to permit the pack roll support member to be rotatable about the spindle bearing housing.

10. The winder of claim 9, wherein the pack roll support member includes a pair of ball bushing slides that guide the travel of the carriage along the pack roll support member.

11. The winder of claim 1, wherein the pack roll support assembly is driven to rotate the pack roll support assembly about the spindle bearing housing.

12. The winder of claim 1, further including:

a pack roll positioning assembly for controllably driving the carriage along the pack roll support assembly, the pack roll positioning assembly including a drive screw mechanism that cooperates with the carriage to cause the controlled movement of the carriage.

13. The winder of claim 12, wherein the drive screw mechanism includes a motor that is in communication with a master controller that sends a control signal to the motor to cause the motor to operate for a pre-selected period of time to cause the carriage to move a predetermined distance.

14. The winder of claim 12, further including:

a mechanism for causing movement of the pack roll relative to the spindle and the pack roll support assembly, the motion of the mechanism being independent from the motion of the carriage along the pack roll support assembly.

15. The winder of claim 14, wherein the mechanism comprises:

a pneumatic cylinder that is coupled to and movable with the carriage, the cylinder having an extendable and retractable piston; and an arm coupled to the piston, wherein the pack roll is coupled to the arm such that movement of the arm is translated into a movement of the pack roll.

16. The winder of claim 15, wherein the piston is movable between an extended position and a retracted position, the pack roll being positioned in a forwardmost position closest to the respective core when the piston is in the retracted position and the pack roll being positioned in a rearwardmost position farthest from the respective core when the core is in the extended position.

17. The winder of claim 15, further including:

a pressure regulator operatively coupled to the pneumatic cylinder to ensure that the pneumatic cylinder is continuously operated so that the pack roll applies a substantially constant pre-selected amount of pressure on the winding roll.

18. The winder of claim 15, wherein the mechanism has a range of movement such that once the mechanism approaches an end of the range of movement, a control signal is sent to a motor that drives the carriage resulting in the motor being activated for a pre-selected period of time or speed, whereby the carriage is driven a distance away from the winding roll, the pack roll remaining in contact with the winding roll and applying a substantially constant pressure thereagainst.

19. The winder of claim 18, wherein a limit switch or other control device is tripped by the mechanism near the end of the range of movement, the tripping of the limit switch or control device causing the control signal to be generated and delivered to the motor that drives the carriage.

20. The winder of claim 1, wherein the roll changer is movable along a guide tracks both towards and away from the winding roll, the roll changer including a bumper roll assembly that can be actuated to drive the web material into contact with a new core to initiate winding of the web therearound, the roll changer further including a cutting assembly to cut the web downstream of where the bumper roll assembly contact the web.

21. The winder of claim 1, wherein the first and second end support members are rotated 180 degrees to move one pack roll and new core from a transfer position to a winding position for receipt of the web when the roll changer is actuated, while the other core is moved 180 degrees to an unloading position, the winding of the other core being continuous until the roll changer is actuated to cause the web to wind around the new core.

22. A turret winder comprising: a rotatable turret assembly having a first core and a second core supported thereby, the turret being rotatable so that the first core can be positioned at a first location while the second core is positioned at a different second location, wherein a web material can be wound onto either of the first and second cores at either of the first and second locations; a pack roll assembly associated with each of the first and second cores, the pack roll assembly including one pack roll that is movable into contact with one core with a winding roll thereon so that a web leading onto the one core from a web source contacts the associated pack roll at or prior to winding thereof on the winding roll for excluding entrapped air prior to forming of convolutions on the roll in a winding position at either of the first and second locations and locations therebetween, and wherein each of the first and second cores is unloaded at the first location after the winding is completed thereon and a new core is loaded at the same first location, while the other of the first and second cores is continuously winding at the second location, the turret and pack roll assemblies being configured to permit the new core to be rotated to the second location, while the core with the winding roll thereon is rotated to perform unloading at the first location without any interruption of winding thereon, wherein each pack roll assembly including the respective pack roll and a mechanism for moving and maintaining the pack roll in contact with the respective one core with the winding roll thereon being independently rotatable relative to the respective one core with the winding roll and relative to the other pack roll assembly, wherein each of the pack roll assemblies includes a pack roll support member on which a carriage travels in a controlled movement, the pack roll support member having an opening formed therethrough that receives one respective spindle bearing housing to permit the pack roll support member to be rotatable about the spindle bearing housing.

23. The winder of claim 22, further including:

first and second rotatable end support members;

two pairs of first and second spindle support assemblies that are movable along respective guide tracks that are disposed outside of the first and second rotatable end support members, each spindle support assembly having a spindle bearing housing that extends through an opening formed in one of the first and second end support members, each of the spindle bearing housings includes a drive feature for coupling with and for driving a spindle that supports one core for winding rolls thereon, the first and second spindle support assemblies of each pair being drivable along the guide tracks in directions both toward and away from the end support members to accommodate spindles of varying lengths, wherein the pack roll assemblies are disposed concentric with and rotatable about the spindle bearing housings, one for each spindle end, each of the pack roll assemblies having a carriage that controllably travels along a length thereof, the carriage rotatably carrying one pack roll.

24. The winder of claim 22, wherein the pack roll support member includes a pair of ball bushing slides that guide the travel of the carriage along the pack roll support member.

25. The winder of claim 22, wherein the pack roll assembly is driven by a motor for rotating the pack roll support assembly about the spindle bearing housing.

26. The winder of claim 22, further including:

a pack roll positioning assembly for controllably driving the carriage along the pack roll support assembly, the pack roll positioning assembly including a drive screw mechanism that cooperates with the carriage to cause the controlled movement of the carriage.

27. The winder of claim 26, wherein the drive screw mechanism includes a motor that is in communication with a master controller that sends a control signal to the motor to cause the motor to operate for a pre-selected period of time or speed to cause the carriage to move a predetermined distance.

28. The winder of claim 22, further including:

a mechanism for causing movement of the pack roll relative to the spindle and the pack roll support assembly, the motion of the mechanism being independent from the motion of the carriage along the pack roll support assembly.

29. The winder of claim 22, wherein the pack roll contacts the core at a tangential point of the web onto the winding roll.

* * * * *